US012692033B2

(12) United States Patent
Pipes et al.

(10) Patent No.: US 12,692,033 B2
(45) Date of Patent: Jul. 28, 2026

(54) APPARATUS AND METHOD FOR MANUFACTURING A POUCHED PRODUCT

(71) Applicant: NICOVENTURES TRADING LIMITED, London (GB)

(72) Inventors: Jerry Wayne Pipes, Clemmons, NC (US); Balager Ademe, Winston-Salem, NC (US); Matthew Dean Griffitts, Thomasville, NC (US)

(73) Assignee: Nicoventures Trading Limited, London (GB)

( * ) Notice: Subject to any disclaimer, the term of this patent is extended or adjusted under 35 U.S.C. 154(b) by 0 days.

(21) Appl. No.: 19/120,120

(22) PCT Filed: Oct. 12, 2023

(86) PCT No.: PCT/IB2023/060319

§ 371 (c)(1),
(2) Date: Apr. 10, 2025

(87) PCT Pub. No.: WO2024/079697

PCT Pub. Date: Apr. 18, 2024

(65) Prior Publication Data

US 2026/0131923 A1 May 14, 2026

Related U.S. Application Data

(60) Provisional application No. 63/416,310, filed on Oct. 14, 2022.

(51) Int. Cl.

| | |
|---|---|
| ***B65B 29/00*** | (2006.01) |
| ***B65B 9/20*** | (2012.01) |
| ***B65B 29/10*** | (2006.01) |
| ***B65B 31/04*** | (2006.01) |
| *A24F 23/02* | (2006.01) |

(52) U.S. Cl.
CPC ..... *B65B 29/10* (2013.01); *B65B 9/2021* (2013.01); *B65B 31/044* (2013.01); *A24F 23/02* (2013.01)

(58) Field of Classification Search
CPC ..... B65B 29/10; B65B 9/2021; B65B 31/044; B65B 9/2056; B65B 2230/02;
(Continued)

(56) References Cited

U.S. PATENT DOCUMENTS 4,894,978 A * 1/1990 Schonmann ..... A61K 9/4833 53/238
7,861,728 B2 1/2011 Holton, Jr. et al.
(Continued)

FOREIGN PATENT DOCUMENTS

EP 2611314 B1 6/2014

*Primary Examiner* — Jacob A Smith
(74) *Attorney, Agent, or Firm* — Womble Bond Dickinson (US) LLP; Chris Humphrey; John V. Forcier

(57) ABSTRACT

An apparatus (1) and method for manufacturing a pouched product involve a forming unit (50) arranged to feed a continuous supply of a pouch material (20) configured as a continuous channel member. A dosage unit (500) is operably engaged with the forming unit (50) and is arranged to introduce a dose of a filler material (130), having at least one object (134) within the dose, into a pouched portion of the channel member, the pouched portion having a closed leading edge such that the pouched portion is arranged to retain the dose of the filler material (130), having the at least one object (134) within the dose, within the pouched portion. An object metering unit (300) is arranged to introduce objects (134) into the dosage unit (500), and includes a rotatable feed member (248) arranged to meter the objects (134) introduced into the dosage unit (500) so as to direct the at least one object (134) into the dose of the filler material (130).

49 Claims, 16 Drawing Sheets

Figure 1:
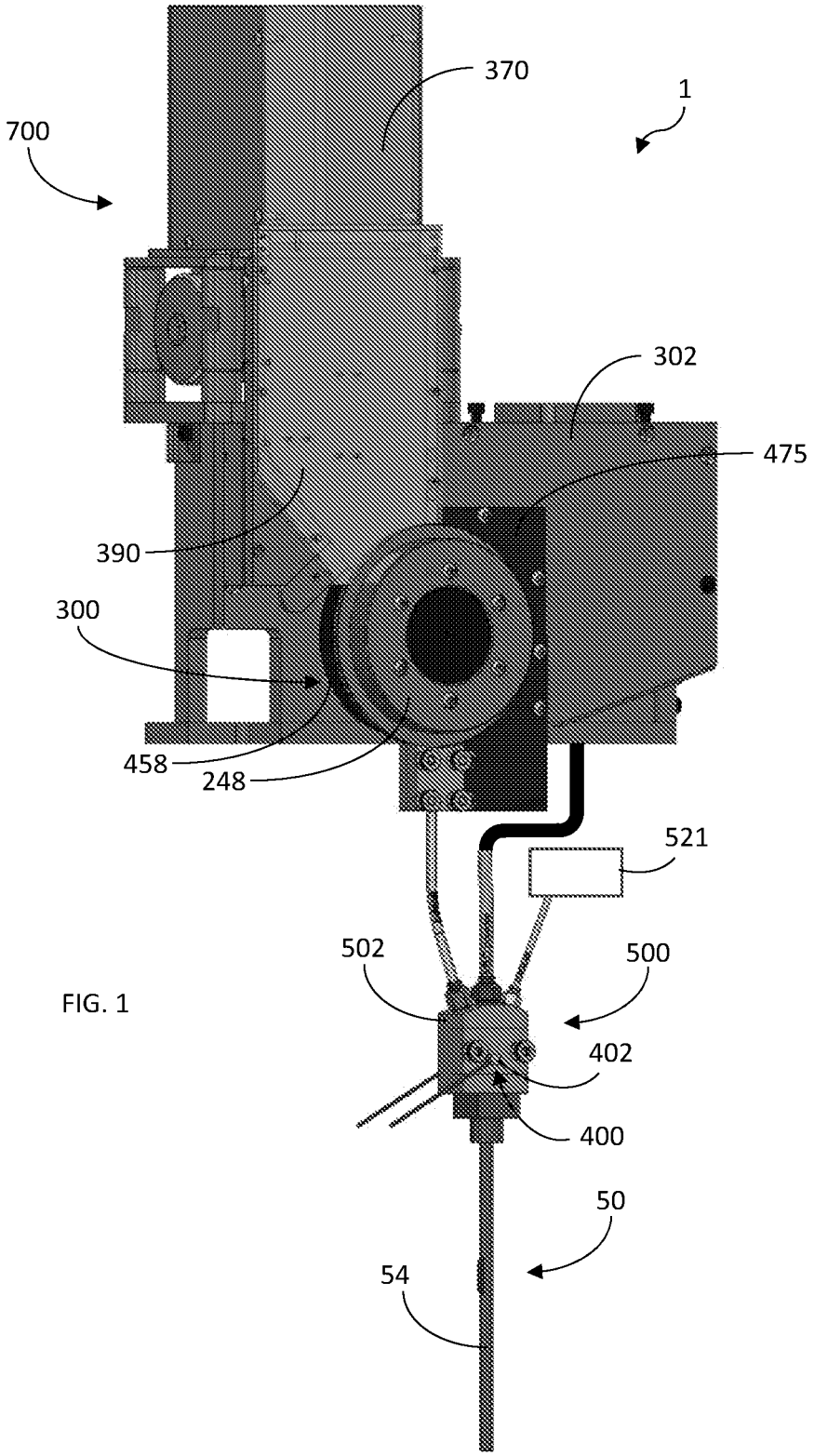

(58) Field of Classification Search
CPC ..... B65B 9/213; B65B 51/303; B65B 9/20; B65B 2220/14; B65B 2220/10; B65B 29/08; B65B 2220/08; B65B 9/2028; B65D 81/3261; B65D 75/54; B65D 81/3266; B65D 81/3272; B65D 75/5805; B65D 75/5827; B65D 33/2508; B65D 2575/586; A24F 23/02
USPC ... 53/52, 155, 445, 451, 474, 238, 450, 455, 53/551, 133.8, 154, 168, 170, 237, 239
See application file for complete search history.

(56) References Cited

U.S. PATENT DOCUMENTS

| | | | | |
|---|---|---|---|---|
| 7,972,254 | B2 * | 7/2011 | Stokes | A24D 3/0229 493/47 |
| 11,006,662 | B1 * | 5/2021 | Williams | A24D 3/0287 |
| 2006/0135335 | A1 * | 6/2006 | Dawson | A24D 3/0216 493/39 |
| 2007/0127853 | A1 * | 6/2007 | Bezek | B65B 9/20 53/445 |
| 2012/0055493 | A1 * | 3/2012 | Novak, III | A24B 13/00 131/111 |
| 2013/0192168 | A1 * | 8/2013 | Bracegirdle | B28C 7/064 53/451 |
| 2016/0176556 | A1 * | 6/2016 | Jaouen | B65B 35/30 53/168 |
| 2021/0186081 | A1 | 6/2021 | Gerardi et al. | |
| 2021/0206554 | A1 | 7/2021 | Holton, Jr. et al. | |

* cited by examiner

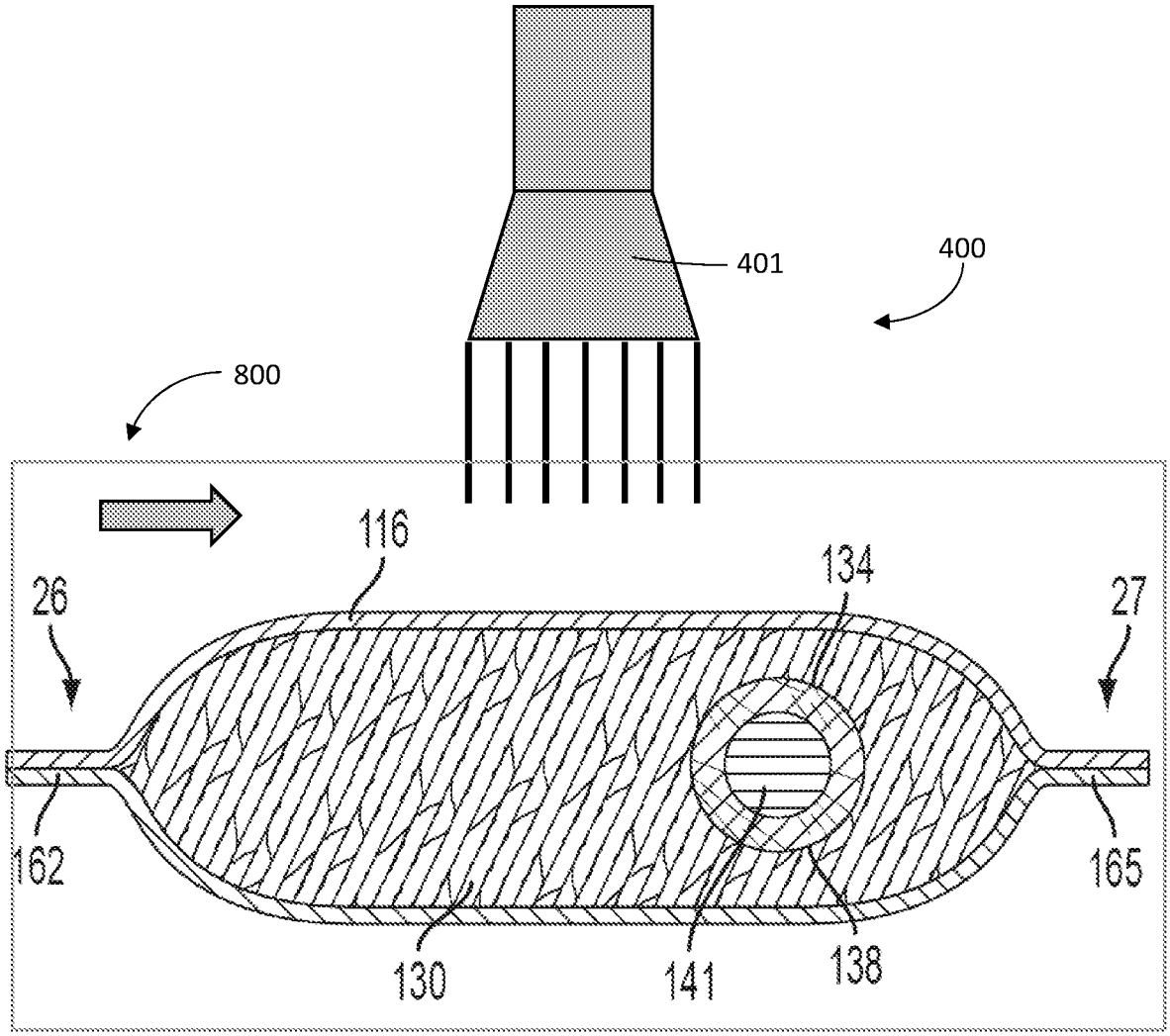
FIG. 10A
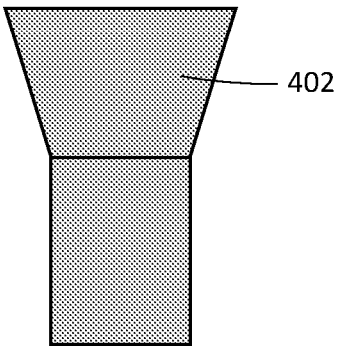

APPARATUS AND METHOD FOR MANUFACTURING A POUCHED PRODUCT

CROSS-REFERENCE TO RELATED APPLICATIONS

This application is a national stage filing under 35 U.S.C. 371 of PCT/IB2023/060319, filed Oct. 12, 2023, which International Application was published by the International Bureau in English on Apr. 18, 2024, as WO 2024/079697, and application claims priority from U.S. Application No. 63/416,310, filed on Oct. 14, 2022, which applications are hereby incorporated in their entirety by reference in this application.

FIELD OF THE DISCLOSURE

Aspects of the present disclosure are directed to an apparatus and method for manufacturing oral pouched products.

BACKGROUND

There are many categories of products intended for oral use and enjoyment. For example, oral tobacco products containing nicotine, which is known to have both stimulant and anxiolytic properties, have been available for many years. Conventional formats for so-called "smokeless" tobacco products include moist snuff, snus, and chewing tobacco, which are typically formed almost entirely of particulate, granular, or shredded tobacco, and which are either portioned by the user or presented to the user in individual portions, such as in single-use pouches or sachets. See for example, the types of smokeless tobacco formulations, ingredients, and processing methodologies set forth in U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,627,828 to Strickland et al.; U.S. Pat. No. 11,246,334 to Atchley, each of which is incorporated herein by reference.

In addition, traditional tobacco materials and non-tobacco materials have been combined with other ingredients to form product formats distinct from traditional smokeless products, with example formats including lozenges, pastilles, gels, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference.

There is continuing interest in the development of new types of oral products that deliver advantageous sensorial or biological activity. Such products typically contain flavorants and/or active ingredients such as nicotine, caffeine, botanicals, or cannabidiol. The format of such products can vary, and include pouched products containing a powdered or granular composition, lozenges, pastilles, liquids, gels, emulsions, meltable compositions, and the like. See, for example, the types of products described in US Patent App. Pub. Nos. 2022/0160675 to Gerardi et al.; 2022/0071984 to Poole et al.; 2021/0378948 to Gerardi et al.; 2021/0330590 to Hutchens et al.; 2021/0186081 to Gerardi et al.; 2021/0177754 to Keller et al; 2021/0177043 to Gerardi et al.; 2021/0177038 to Gerardi et al.; 2021/0169867 to Holton, Jr. et al.; 2021/0169792 to Holton, Jr. et al.; 2021/0169132 to Holton, Jr. et al.; 2021/0169121 to St. Charles, and 2021/0169122 to St. Charles, each of which is incorporated herein by reference. There is continuing interest in the art to develop additional products for oral consumption, which can exhibit various release rates of active ingredients and/or enhanced shelf stability. Some users might be interested in an oral product that is capable of providing, in some instances, selectively, a variety of different flavors, depending upon the user's immediate preference. The flavor of such an oral product might be selected based on the user's preference for a particular flavor at that time, or interest in changing flavors during use. For example, changing flavors during use may enable a user to end the experience with a breath freshening flavor, such as menthol or spearmint. Accordingly, it would be appreciated to have an oral product that is capable of providing distinctive, different pleasurable sensory experiences, for a user. Some users might also be interested in an oral product that is capable of modifying the nature or character of the sensory experience generated by that oral product.

In this regard, oral products, and in particular oral pouched products, can incorporate objects, beads, capsules and capsule components such as those set forth in U.S. Patent Pub. Nos. 2006/0272663 to Dube et al., 2006/01330961 to Luan et al., 2006/0144412 to Mishra et al.; 2007/0012327 to Karles et al.; 2007/0068540 to Thomas et al.; 2008/0029110 to Dube et al.; and 2011/0271968 to Carpenter et al.; PCT WO 2006/136197; PCT WO 2006/136199; PCT WO 2007/010407 PCT WO 2007/060543 and U.S. Pat. No. 7,115,085 to Deal; and U.S. Pat. No. 7,972,254 to Stokes et al.; as well as within filtered cigarettes that have been marketed under the tradenames "Camel Lights with Menthol Boost" and "Camel Crush" by R. J. Reynolds Tobacco Company. Exemplary pelletized carrier materials and flavor packages are of the type employed in cigarettes that have been marketed commercially in the USA. For example, flavor-carrying pellets have been incorporated into cigarette filters employed on Camel brand cigarettes under the tradenames Mandalay Lime, Mandarin Mint, Breach Breezer, Back Ally Blend, Snakeyes Scotch, Izmir Stinger, Kauai Kolada, Midnight Madness, Aegean Spice, Screwdriver Slots, Twist, Twista Lime, Dark Mint and Blackjack Gin; Kool brand cigarettes under the tradenames Flow and Groove; and Salem brand cigarettes under the tradename Deep Freeze; all of which have been marketed by R. J. Reynolds Tobacco Company.

In some instances, a user would appreciate having the ability to enhance a sensory aspect of his/her oral product sensory experience, and the extent or magnitude of that sensory experience, such as can be accomplished by allowing the user to purposefully select an oral product having certain characteristics or behaviors and, in some instances, by allowing the user to determine the magnitude or extent of such characteristics or behaviors that the oral product exhibits. That is, it would be appreciated to have oral product possessing components that can be employed so as to allow the user to select an oral product based on an indicated character or nature and, in some instances, allow the user to control, whether selectively or not, the nature or character of the sensory characteristic produced by that oral product, and the source from which it is obtained. In particular, it would be appreciated to have an oral product that is capable of enhancing the sensory attributes, and the extent or magnitude of such attributes, of the sensory characteristic (e.g., flavoring). More particularly, it would be appreciated to have the capability of manufacturing such oral products incorporating such flavor agents and sources, and the like, in a rapid, highly-automated fashion. It also would be appreciated to have improved provisions for incorporating product-altering solid objects such as flavor pellets, flavor capsules, or possibly various combinations thereof, into oral products, in a rapid, highly automated fashion. It would additionally be appreciated that such manufacturing capabilities include the capability of inspecting and/or monitoring the manufacturing apparatus, the as-formed oral product, and/or component(s) of the oral product prior to the formation thereof.

SUMMARY OF THE DISCLOSURE

The above and other needs are met by aspects of the present disclosure which, in one aspect, provides an apparatus for manufacturing a pouched product. Such an apparatus comprises a forming unit arranged to feed a continuous supply of a pouch material configured as a continuous channel member defining a longitudinal axis. A dosage unit is operably engaged with the forming unit and arranged to introduce a dose of a filler material, having at least one object within the dose, into a pouched portion of the channel member, the pouched portion having a closed leading edge such that the pouched portion is arranged to retain the dose of the filler material, having the at least one object within the dose, within the pouched portion. An object metering unit is arranged to introduce objects into the dosage unit, and includes a rotatable feed member arranged to meter the objects introduced into the dosage unit so as to direct the at least one object into the dose of the filler material.

Another aspect of the present disclosure provides a method of manufacturing a pouched product. Such a method comprises feeding a continuous supply of a pouch material using a forming unit, with the pouch material being configured as a continuous channel member defining a longitudinal axis. A dose of a filler material, having at least one object within the dose, is introduced into a pouched portion of the channel member using a dosage unit, wherein the pouched portion has a closed leading edge such that the pouched portion is arranged to retain the dose of the filler material, having the at least one object within the dose, within the pouched portion. Objects are introduced into the dosage unit, using an object metering unit including a rotatable feed member, by metering the objects introduced into the dosage unit using the rotatable feed member so as to direct the at least one object into the dose of the filler material.

The present disclosure thus includes, without limitation, the following example embodiments:

Example Embodiment 1: An apparatus for manufacturing a pouched product, the apparatus comprising a forming unit arranged to feed a continuous supply of a pouch material configured as a continuous channel member defining a longitudinal axis; a dosage unit operably engaged with the forming unit and arranged to introduce a dose of a filler material, having at least one object within the dose, into a pouched portion of the channel member, the pouched portion having a closed leading edge such that the pouched portion is arranged to retain the dose of the filler material, having the at least one object within the dose, within the pouched portion; and an object metering unit arranged to introduce objects into the dosage unit, and including a rotatable feed member arranged to meter the objects introduced into the dosage unit so as to direct the at least one object into the dose of the filler material.

Example Embodiment 2: The apparatus of any preceding example embodiment, or combinations thereof, comprising an inspection unit operably engaged between the object metering unit and the forming unit and arranged to inspect the at least one object, or the dose of the filler material having the at least one object within the dose, the inspection unit including an emitter arranged to oppose a detector such that at least the at least one object is directed therebetween.

Example Embodiment 3: The apparatus of any preceding example embodiment, or combinations thereof, wherein the inspection unit is arranged between the object metering unit and the dosage unit, or is operably engaged with the dosage unit, to inspect the at least one object, prior to the at least one object being introduced into the dose of the filler material.

Example Embodiment 4: The apparatus of any preceding example embodiment, or combinations thereof, wherein the inspection unit is operably engaged with the dosage unit, prior to the forming unit, and arranged to inspect the at least one object upon or after the at least one object being introduced into the dose of the filler material.

Example Embodiment 5: The apparatus of any preceding example embodiment, or combinations thereof, wherein the emitter is a light emitter and wherein the detector is arranged to detect light transmitted through and around the at least one object, or through and around the at least one object within the dose of the filler material, to determine an integrity of the at least one object or to determine a presence or absence of the at least one object within the dose of the filler material.

Example Embodiment 6: The apparatus of any preceding example embodiment, or combinations thereof, wherein the forming unit is arranged to close a first portion of the channel member to form the closed leading edge of the pouched portion and a closed trailing edge of a previous pouched portion, and to close a second portion of the channel member to form a closed trailing edge of the pouched portion and a closed leading edge of a subsequent pouched portion.

Example Embodiment 7: The apparatus of any preceding example embodiment, or combinations thereof, wherein the forming unit is arranged to divide the channel member through the longitudinal axis, between the closed trailing edge and the closed leading edge of the respective pouched portions serially disposed along the longitudinal axis of the channel member, into a plurality of discrete pouched products such that each discrete pouched product includes therein the dose of the filler material, having the at least one object within the dose.

Example Embodiment 8: The apparatus of any preceding example embodiment, or combinations thereof, comprising a conveying unit arranged to receive the pouched products from the forming unit and to convey the pouched products to a packaging unit for packaging the pouched products.

Example Embodiment 9: The apparatus of any preceding example embodiment, or combinations thereof, comprising an inspection unit operably engaged with the conveying unit and arranged prior to the packaging unit to inspect each pouched product directed to the packaging unit, the inspection unit including an emitter arranged to oppose a detector such that the pouched products are conveyed therebetween.

Example Embodiment 10: The apparatus of any preceding example embodiment, or combinations thereof, wherein the emitter is a light emitter and wherein the detector is arranged to detect light transmitted by the emitter through each conveyed pouched product to determine a presence or absence of the at least one object within the pouched product or to determine an integrity of the at least one object within the pouched product.

Example Embodiment 11: The apparatus of any preceding example embodiment, or combinations thereof, wherein the conveying unit is arranged to divert any pouched product, determined by the inspection unit to demonstrate the absence of the at least one object within the pouched product or to demonstrate a lack of integrity of the at least one object within the pouched product, away from the packaging unit.

Example Embodiment 12: The apparatus of any preceding example embodiment, or combinations thereof, wherein the dosage unit comprises a body member defining a filler channel extending therethough between a filler inlet and an outlet, and an object channel extending from an object inlet into communication with the filler channel between the filler inlet and the outlet, the object channel being arranged to receive the at least one object through the object inlet from the object metering unit in communication therewith, and to direct the at least one object into the filler channel, and the filler channel being arranged to receive the dose of the filler material through the filler inlet, to receive the at least one object from the object channel into the dose of the filler material, and to direct the dose of the filler material including the at least one object to the outlet for introduction of the dose into the pouched portion of the channel member.

Example Embodiment 13: The apparatus of any preceding example embodiment, or combinations thereof, wherein the body member defines a purge channel in communication with the object channel or the filler channel, before the outlet, the purge channel being arranged to receive a selectively actuated flow of a purge substance therein to clear the object channel or the filler channel of any objects or filler material remaining therein.

Example Embodiment 14: The apparatus of any preceding example embodiment, or combinations thereof, comprising an object transfer unit operably engaged with the object metering unit, the object transfer unit being arranged to remove the at least one object from the rotatable feed member and direct the at least one object into the dosage unit and into the dose of the filler material.

Example Embodiment 15: The apparatus of any preceding example embodiment, or combinations thereof, comprising a filler transfer unit operably engaged with the dosage unit, the filler transfer unit being arranged to direct the dose of the filler material into the dosage unit.

Example Embodiment 16: The apparatus of any preceding example embodiment, or combinations thereof, comprising a dose transfer unit operably engaged with the dosage unit, the dosage transfer unit being arranged to direct the dose of the filler material having the at least one object from the dosage unit into the pouched portion.

Example Embodiment 17: The apparatus of any preceding example embodiment, or combinations thereof, comprising a clearing unit operably engaged with the dosage unit, the clearing unit being arranged to be selectively actuated to clear the dosage unit of any objects or filler material remaining therein.

Example Embodiment 18: The apparatus of any preceding example embodiment, or combinations thereof, wherein the feed member is rotatable about an axis and comprises a peripheral surface extending at a radius about the axis, the peripheral surface defining a plurality of angularly spaced-apart pockets each arranged to successively receive the at least one object therein at a receiving position of the feed member, and to dispense the at least one object from each pocket and into the dosage unit upon rotation of the feed member to move successive pockets into a dispensing position of the feed member.

Example Embodiment 19: The apparatus of any preceding example embodiment, or combinations thereof, comprising a retention device operably engaged with the feed member and arranged to retain the at least one object within the respective pocket of the feed member upon rotation of the feed member between the receiving position and the dispensing position.

Example Embodiment 20: The apparatus of any preceding example embodiment, or combinations thereof, wherein the retention device comprises a negative pressure assembly disposed in fluid communication with the feed member and arranged to apply a negative pressure to at least a portion of the pockets to maintain the at least one object within the at least a portion of the pockets during rotation of the feed member between the receiving position and the dispensing position.

Example Embodiment 21: The apparatus of any preceding example embodiment, or combinations thereof, wherein the retention device comprises a retaining member disposed adjacent to the peripheral surface of the feed member and having a retention surface extending adjacent to and along the peripheral surface at least between the receiving position and the dispensing position of the feed member.

Example Embodiment 22: The apparatus of any preceding example embodiment, or combinations thereof, comprising a hopper assembly arranged to receive a plurality of the objects and to manipulate the plurality of objects so as to feed the at least one object therefrom into each pocket defined by the peripheral surface of the feeder device upon rotation thereof to the receiving position.

Example Embodiment 23: The apparatus of any preceding example embodiment, or combinations thereof, comprising an agitation device arranged to interact with the hopper assembly so as to agitate the objects therein and facilitate feeding of the objects into the pockets of the feeder device.

Example Embodiment 24: The apparatus of any preceding example embodiment, or combinations thereof, wherein the object metering unit is arranged to introduce objects including capsules, pellets, microcapsules, beads, rods, flavoring agent members, or combinations thereof.

Example Embodiment 25: A method of manufacturing a pouched product, the method comprising feeding a continuous supply of a pouch material using a forming unit, the pouch material being configured as a continuous channel member defining a longitudinal axis; introducing a dose of a filler material, having at least one object within the dose, into a pouched portion of the channel member using a dosage unit, the pouched portion having a closed leading edge such that the pouched portion is arranged to retain the dose of the filler material, having the at least one object within the dose, within the pouched portion; and introducing objects into the dosage unit, using an object metering unit including a rotatable feed member, by metering the objects introduced into the dosage unit using the rotatable feed member so as to direct the at least one object into the dose of the filler material.

Example Embodiment 26: The method of any preceding example embodiment, or combinations thereof, comprising inspecting the at least one object, or the dose of the filler material having the at least one object within the dose, using an inspection unit operably engaged between the object metering unit and the forming unit, the inspection unit including an emitter arranged to oppose a detector such that at least the at least one object is directed therebetween.

Example Embodiment 27: The method of any preceding example embodiment, or combinations thereof, comprising inspecting the at least one object with the inspection unit arranged between the object metering unit and the dosage unit, or operably engaged with the dosage unit, prior to the at least one object being introduced into the dose of the filler material.

Example Embodiment 28: The method of any preceding example embodiment, or combinations thereof, comprising inspecting the at least one object upon or after the at least one object being introduced into the dose of the filler material, with the inspection unit operably engaged with the dosage unit, prior to the forming unit.

Example Embodiment 29: The method of any preceding example embodiment, or combinations thereof, wherein the emitter is a light emitter and wherein inspecting the at least one object, or the dose of the filler material having the at least one object within the dose, comprises detecting, using the detector, light transmitted by the emitter through and around the at least one object, or through and around the at least one object within the dose of the filler material, to determine an integrity of the at least one object or to determine a presence or absence of the at least one object within the dose of the filler material.

Example Embodiment 30: The method of any preceding example embodiment, or combinations thereof, comprising closing a first portion of the channel member, using the forming unit, to form the closed leading edge of the pouched portion and a closed trailing edge of a previous pouched portion.

Example Embodiment 31: The method of any preceding example embodiment, or combinations thereof, comprising closing a second portion of the channel member, using the forming unit, to form a closed trailing edge of the pouched portion and a closed leading edge of a subsequent pouched portion.

Example Embodiment 32: The method of any preceding example embodiment, or combinations thereof, comprising dividing the channel member through the longitudinal axis, using the forming unit, between the closed trailing edge and the closed leading edge of the respective pouched portions serially disposed along the longitudinal axis of the channel member, to form the channel member into a plurality of discrete pouched products with each discrete pouched product including therein the dose of the filler material, having the at least one object within the dose.

Example Embodiment 33: The method of any preceding example embodiment, or combinations thereof, comprising conveying the pouched products, using a conveying unit arranged to receive the pouched products from the forming unit, to a packaging unit for packaging the pouched products.

Example Embodiment 34: The method of any preceding example embodiment, or combinations thereof, comprising inspecting each pouched product directed to the packaging unit, using an inspection unit operably engaged with the conveying unit and arranged prior to the packaging unit, the inspection unit including an emitter arranged to oppose a detector such that the pouched products are conveyed therebetween.

Example Embodiment 35: The method of any preceding example embodiment, or combinations thereof, wherein the emitter is a light emitter and wherein inspecting each pouched product comprises detecting, using the detector, light transmitted by the emitter through each conveyed pouched product to determine a presence or absence of the at least one object within the pouched product or to determine an integrity of the at least one object within the pouched product.

Example Embodiment 36: The method of any preceding example embodiment, or combinations thereof, comprising diverting, using the conveying unit, any pouched product determined by the inspection unit to demonstrate the absence of the at least one object within the pouched product or to demonstrate a lack of integrity of the at least one object within the pouched product, away from the packaging unit.

Example Embodiment 37: The method of any preceding example embodiment, or combinations thereof, wherein the dosage unit comprises a body member defining a filler channel extending therethough between a filler inlet and an outlet, and an object channel extending from an object inlet into communication with the filler channel between the filler inlet and the outlet, and wherein the method comprises receiving the at least one object through the object inlet from the object metering unit in communication therewith and directing the at least one object into the filler channel, receiving the dose of the filler material through the filler inlet, receiving the at least one object from the object channel into the dose of the filler material, and directing the dose of the filler material including the at least one object to the outlet for introduction of the dose into the pouched portion of the channel member.

Example Embodiment 38: The method of any preceding example embodiment, or combinations thereof, wherein the body member defines a purge channel in communication with the object channel or the filler channel, before the outlet, and wherein the method comprises receiving a selectively actuated flow of a purge substance in the purge channel to clear the object channel or the filler channel of any objects or filler material remaining therein.

Example Embodiment 39: The method of any preceding example embodiment, or combinations thereof, comprising removing the at least one object from the rotatable feed member, and directing the at least one object into the dosage unit and into the dose of the filler material, using an object transfer unit operably engaged with the object metering unit.

Example Embodiment 40: The method of any preceding example embodiment, or combinations thereof, comprising directing the dose of the filler material into the dosage unit, using a filler transfer unit operably engaged with the dosage unit.

Example Embodiment 41: The method of any preceding example embodiment, or combinations thereof, comprising directing the dose of the filler material having the at least one object from the dosage unit into the pouched portion, using a dose transfer unit operably engaged with the dosage unit.

Example Embodiment 42: The method of any preceding example embodiment, or combinations thereof, comprising selectively actuating a clearing unit operably engaged with the dosage unit to clear the dosage unit of any objects or filler material remaining therein.

Example Embodiment 43: The method of any preceding example embodiment, or combinations thereof, wherein the feed member is rotatable about an axis and comprises a peripheral surface extending at a radius about the axis, the peripheral surface defining a plurality of angularly spaced-apart pockets, and wherein the method comprises successively receiving the at least one object in each pocket at a receiving position of the feed member, and dispensing the at least one object from each pocket and into the dosage unit upon rotation of the feed member to move successive pockets into a dispensing position of the feed member.

Example Embodiment 44: The method of any preceding example embodiment, or combinations thereof, comprising retaining the at least one object within the respective pocket of the feed member, using a retention device operably engaged with the feed member, upon rotation of the feed member between the receiving position and the dispensing position.

Example Embodiment 45: The method of any preceding example embodiment, or combinations thereof, wherein the retention device comprises a negative pressure assembly disposed in fluid communication with the feed member, and wherein the method comprises applying a negative pressure to at least a portion of the pockets to maintain the at least one object within the at least a portion of the pockets during rotation of the feed member between the receiving position and the dispensing position.

Example Embodiment 46: The method of any preceding example embodiment, or combinations thereof, wherein the retention device comprises a retaining member disposed adjacent to the peripheral surface of the feed member, and wherein the method comprises retaining the at least one object within the at least a portion of the pockets during rotation of the feed member between the receiving position and the dispensing position, using a retention surface of the retaining member extending adjacent to and along the peripheral surface at least between the receiving position and the dispensing position of the feed member.

Example Embodiment 47: The method of any preceding example embodiment, or combinations thereof, comprising receiving a plurality of the objects in a hopper assembly and manipulating the plurality of objects so as to feed the at least one object from the hopper assembly into each pocket defined by the peripheral surface of the feeder device upon rotation thereof to the receiving position.

Example Embodiment 48: The method of any preceding example embodiment, or combinations thereof, comprising agitating the objects within the hopper assembly using an agitation device arranged to interact therewith to facilitate feeding of the objects into the pockets of the feeder device.

Example Embodiment 49: The method of any preceding example embodiment, or combinations thereof, wherein introducing objects into the dosage unit comprises introducing objects, including capsules, pellets, microcapsules, beads, rods, flavoring agent members, or combinations thereof, into the dosage unit.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

It will be appreciated that the summary herein is provided merely for purposes of summarizing some example aspects so as to provide a basic understanding of the disclosure. As such, it will be appreciated that the above described example aspects are merely examples and should not be construed to narrow the scope or spirit of the disclosure in any way. It will be appreciated that the scope of the disclosure encompasses many potential aspects, some of which will be further described below, in addition to those herein summarized. Further, other aspects and advantages of such aspects disclosed herein will become apparent from the following detailed description taken in conjunction with the accompanying drawings which illustrate, by way of example, the principles of the described aspects.

BRIEF DESCRIPTION OF THE SEVERAL VIEWS OF THE DRAWING(S)

Figure 2:
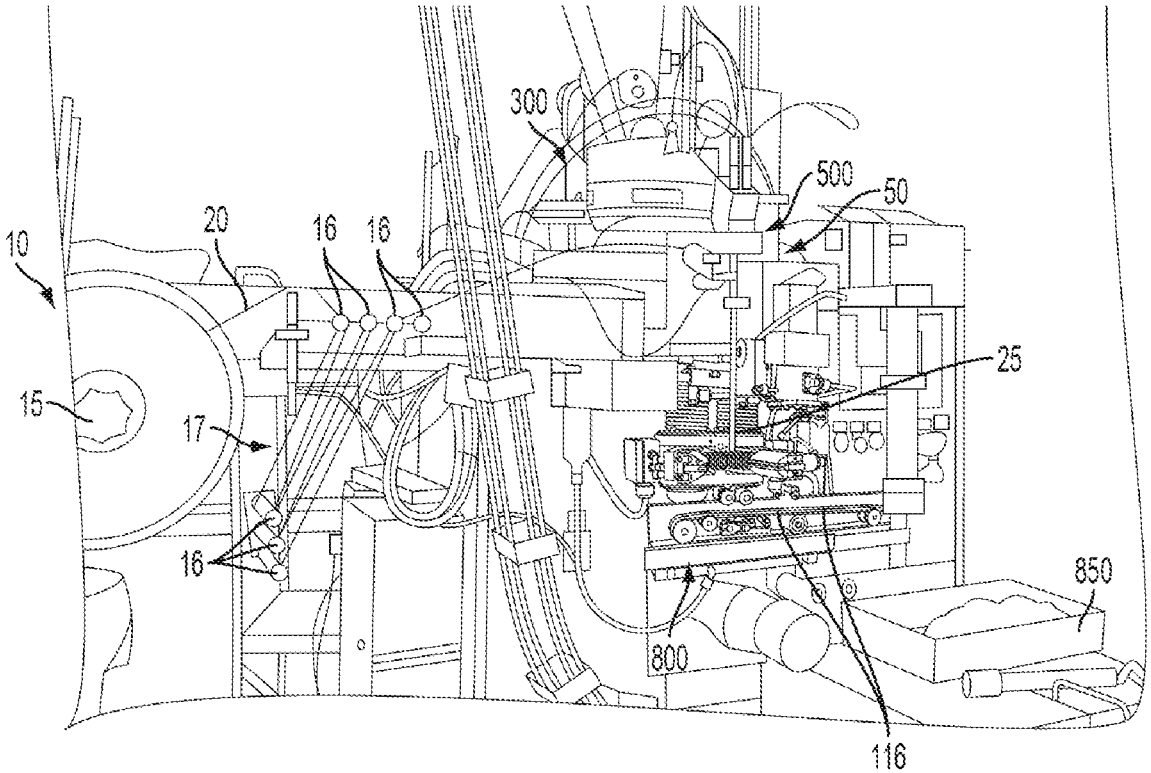
Figure 3:
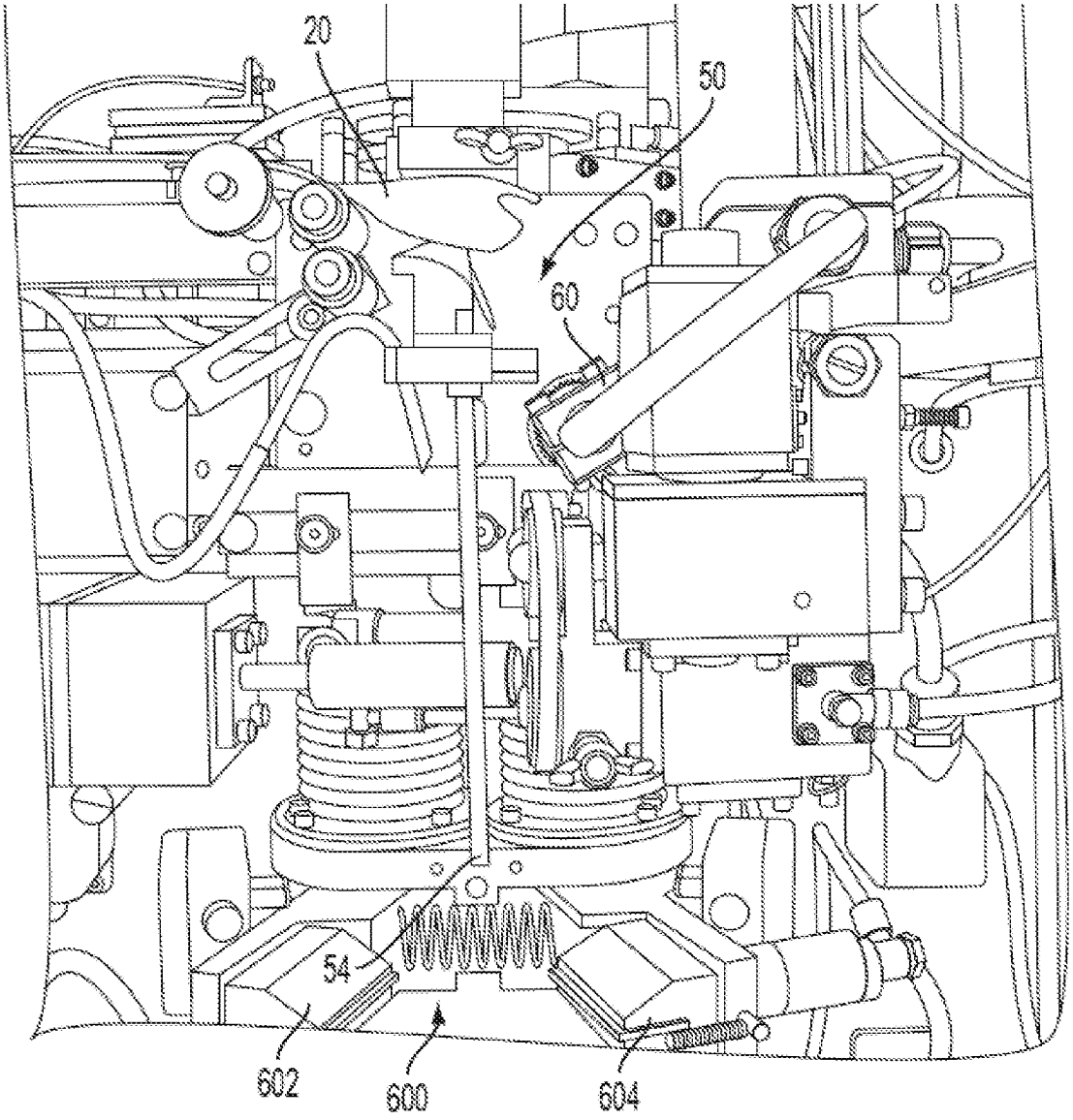
Figure 4:
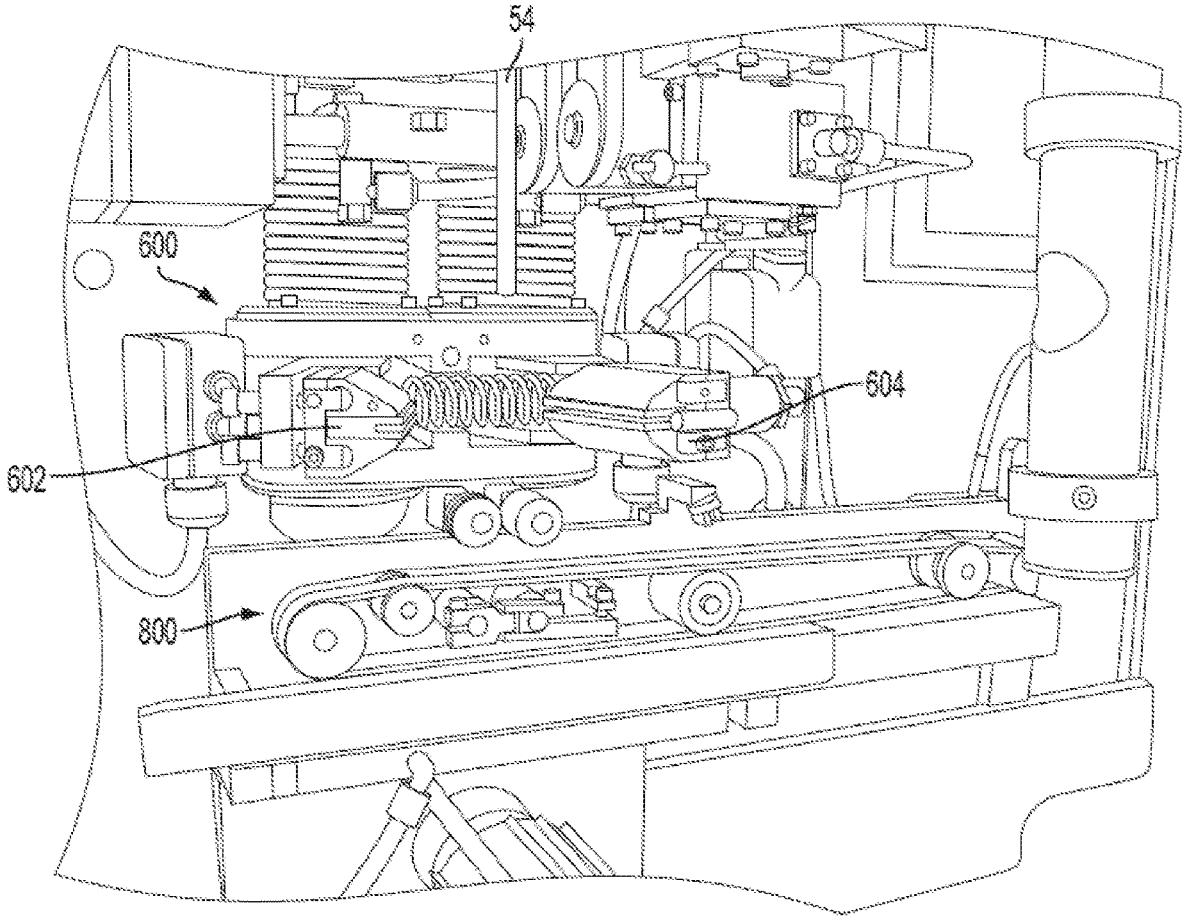
Figure 5:
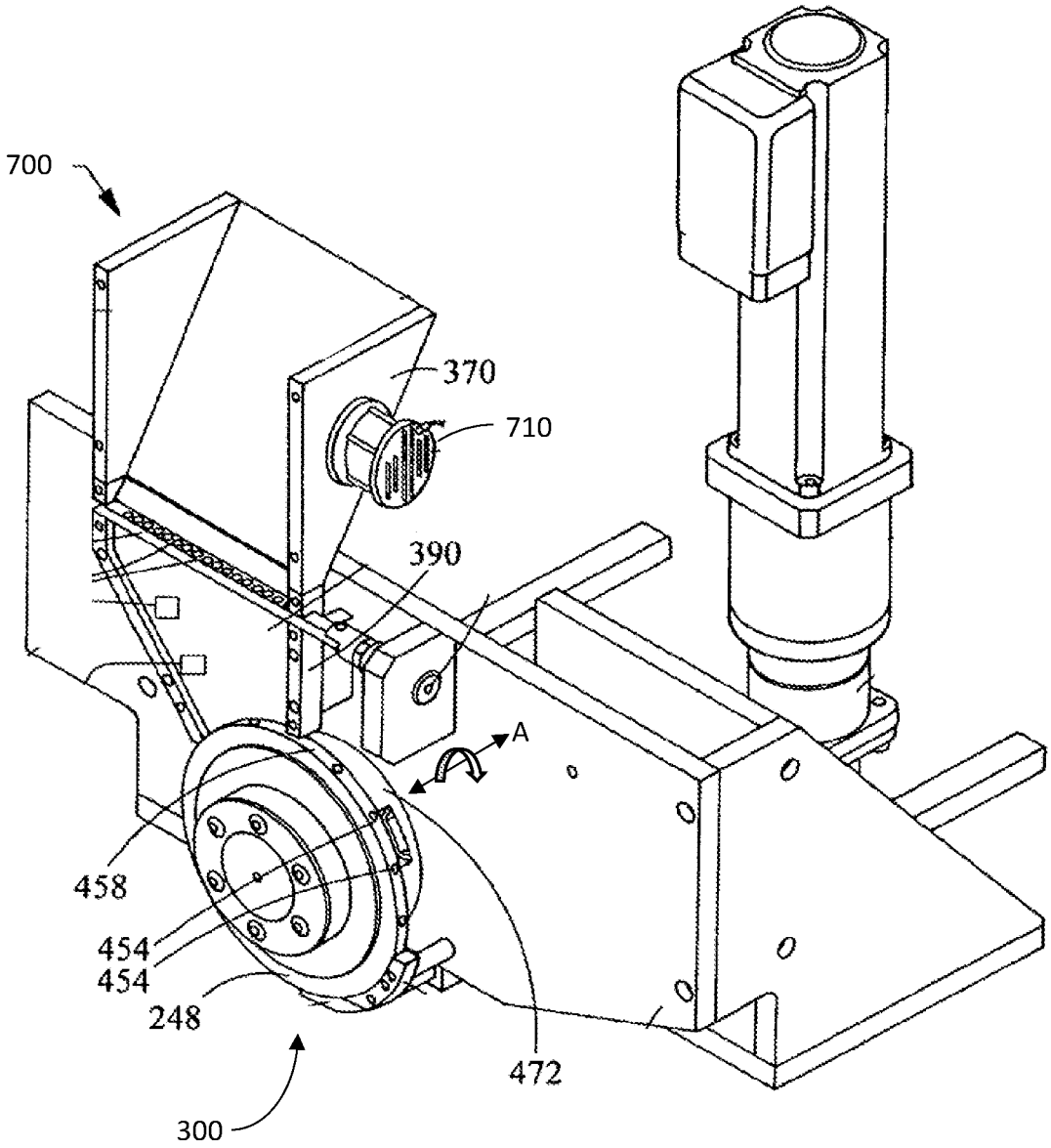
Figure 6A:
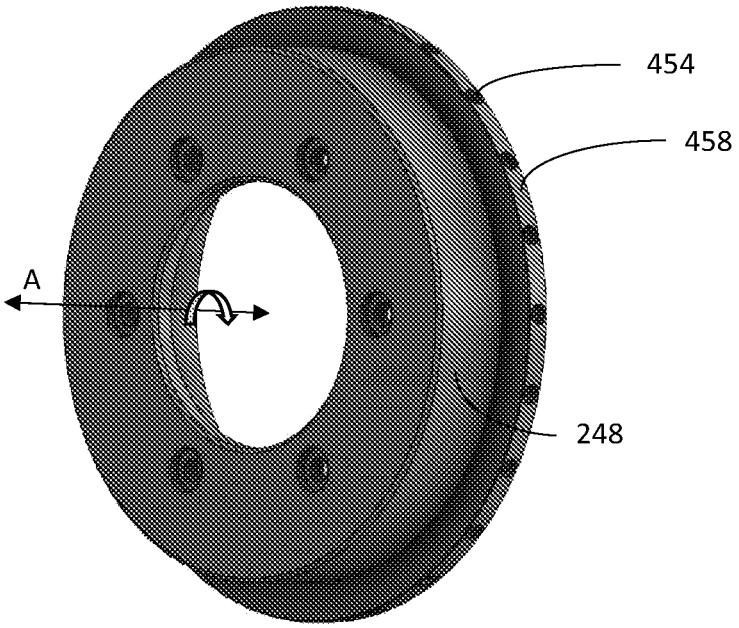
Figure 6B:
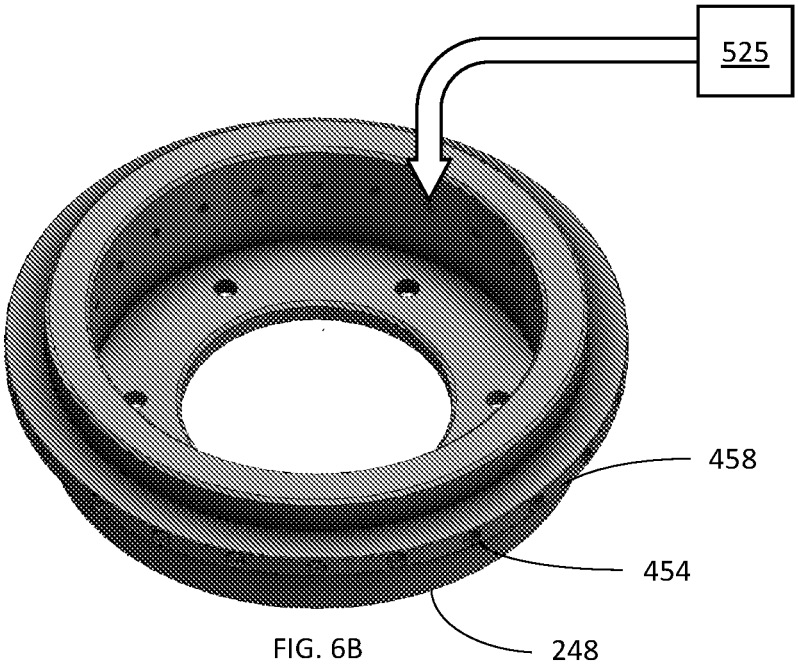
Figure 7:
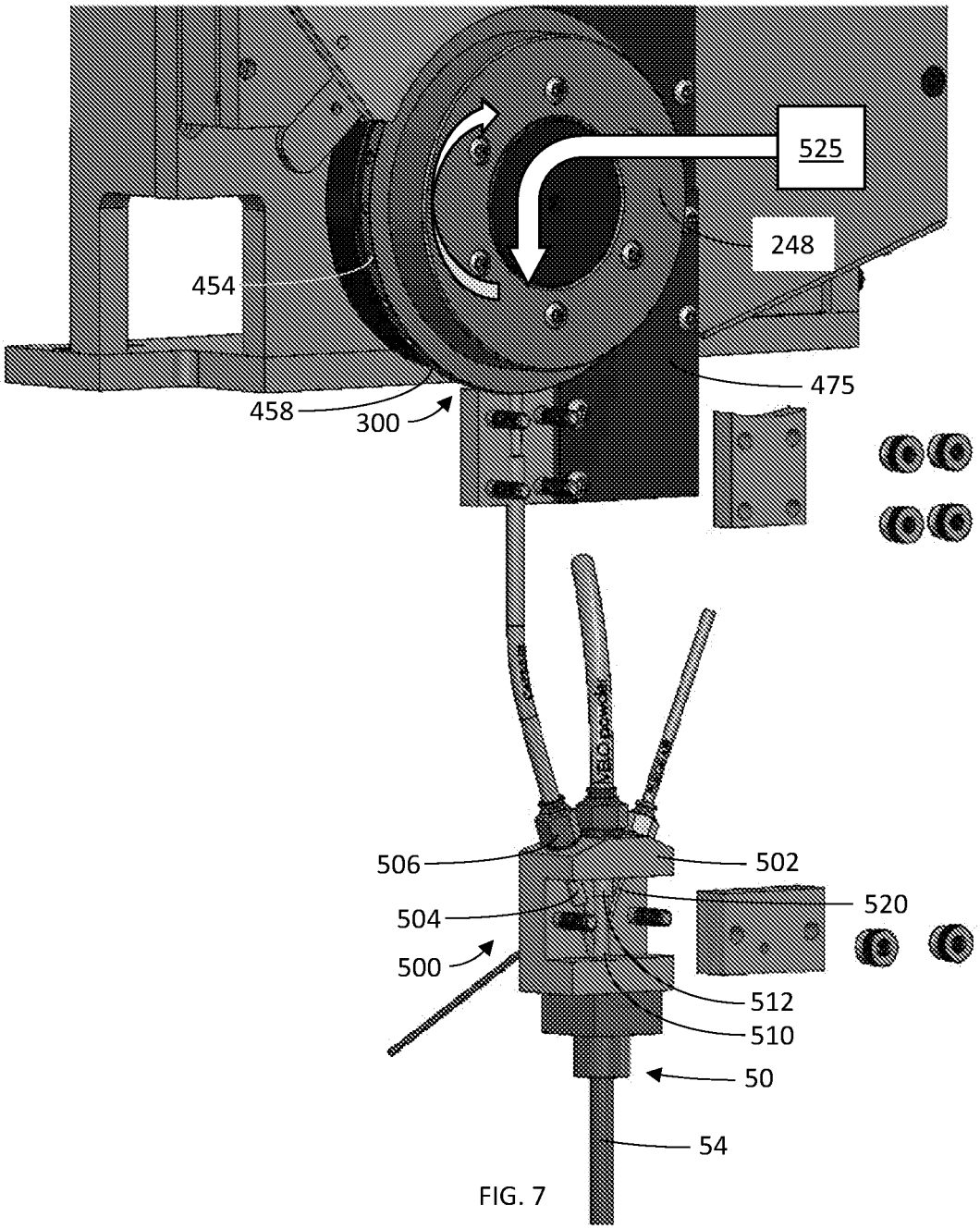
Figure 8A:
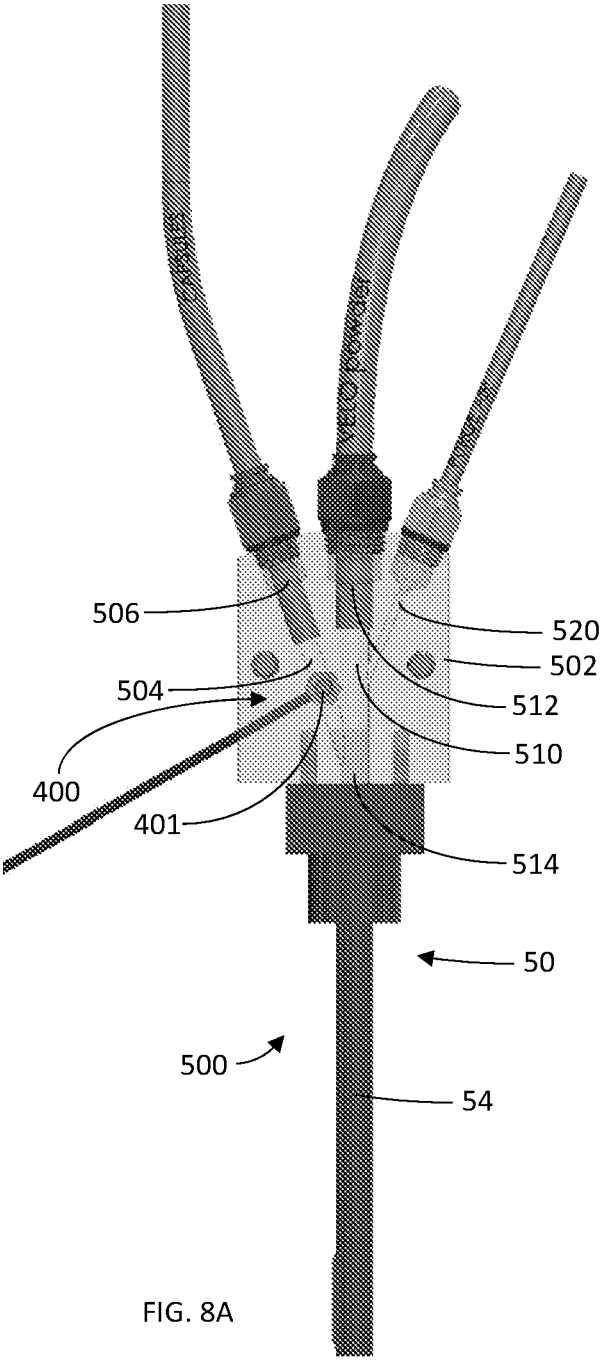
Figure 8B:
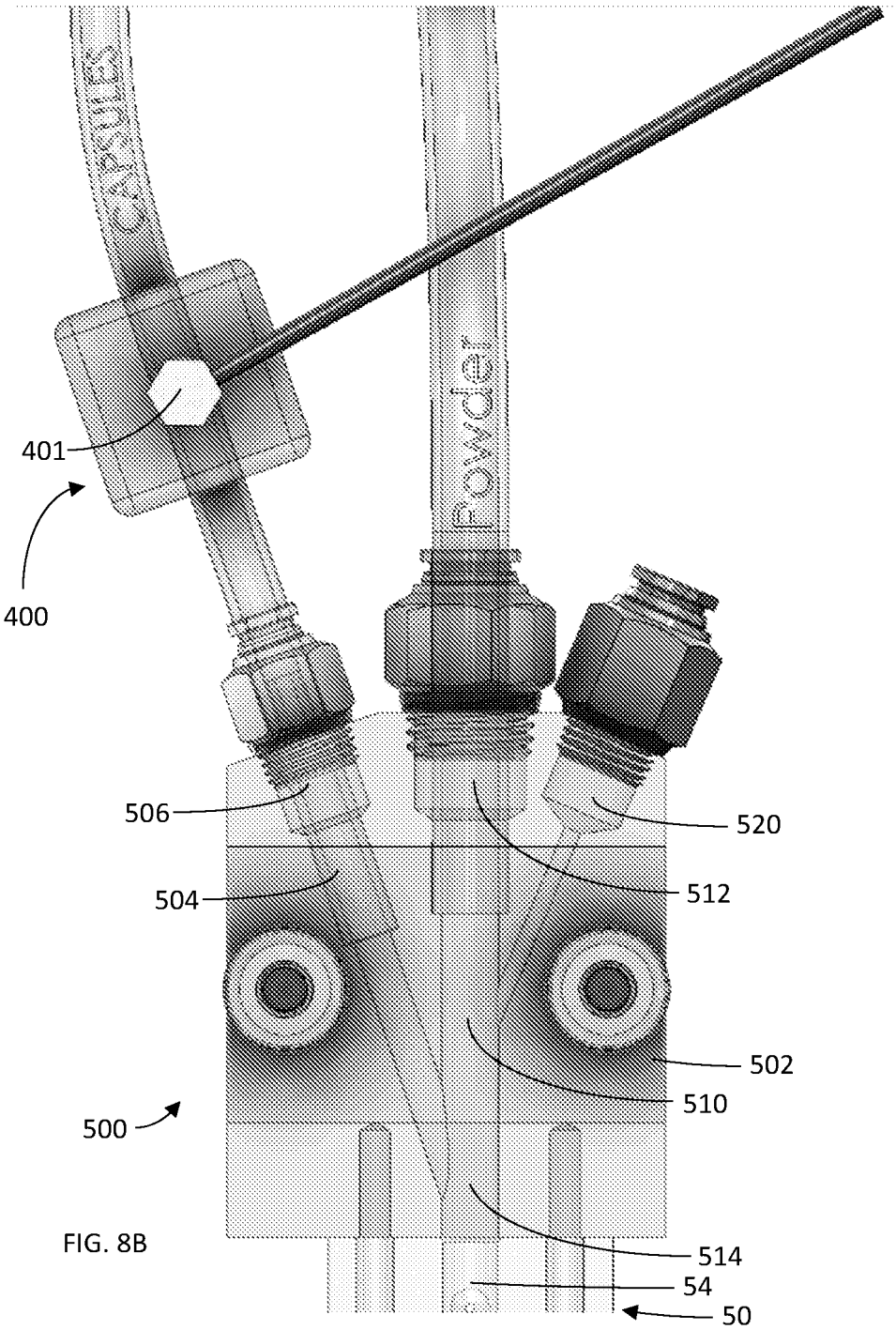
Figure 9:
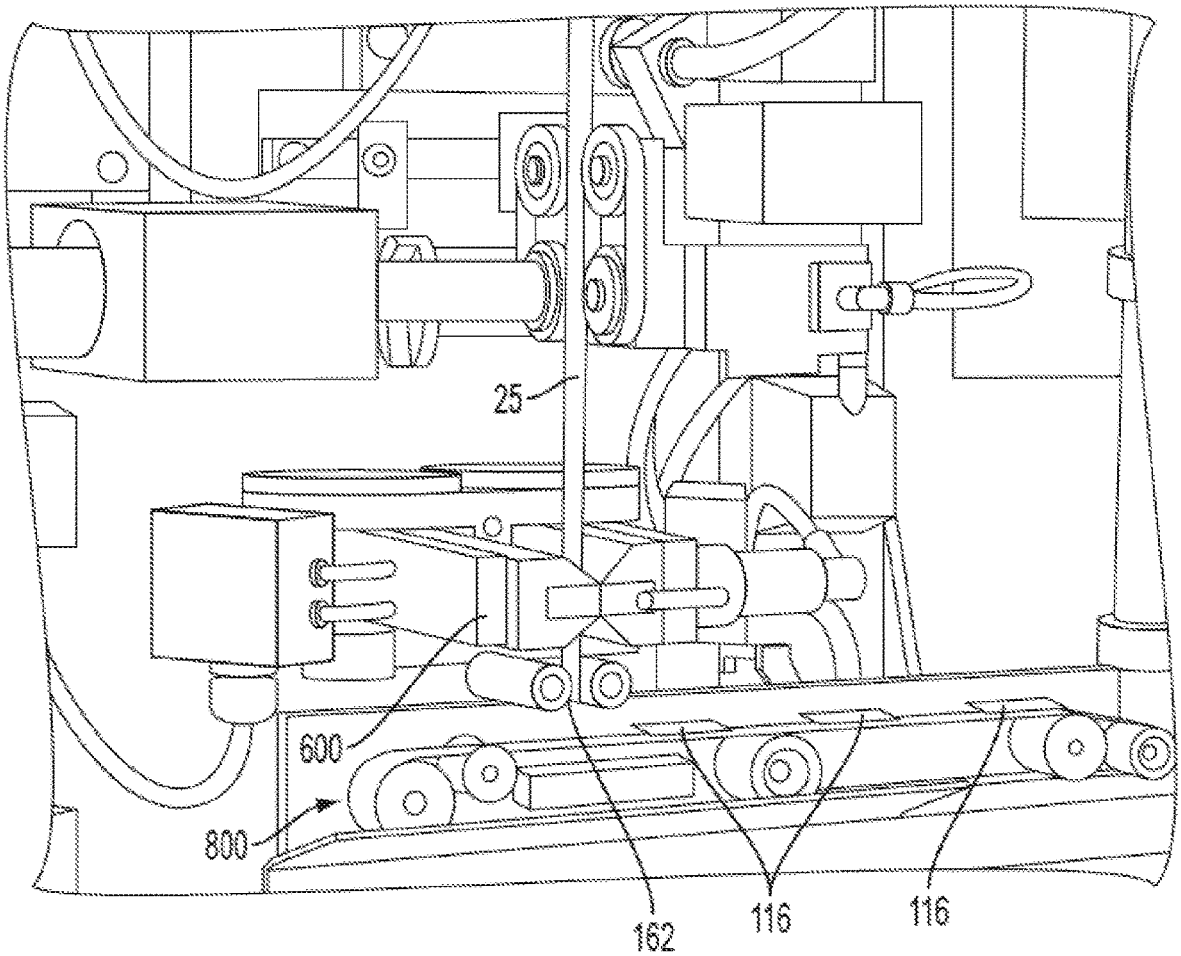
Figure 10B:
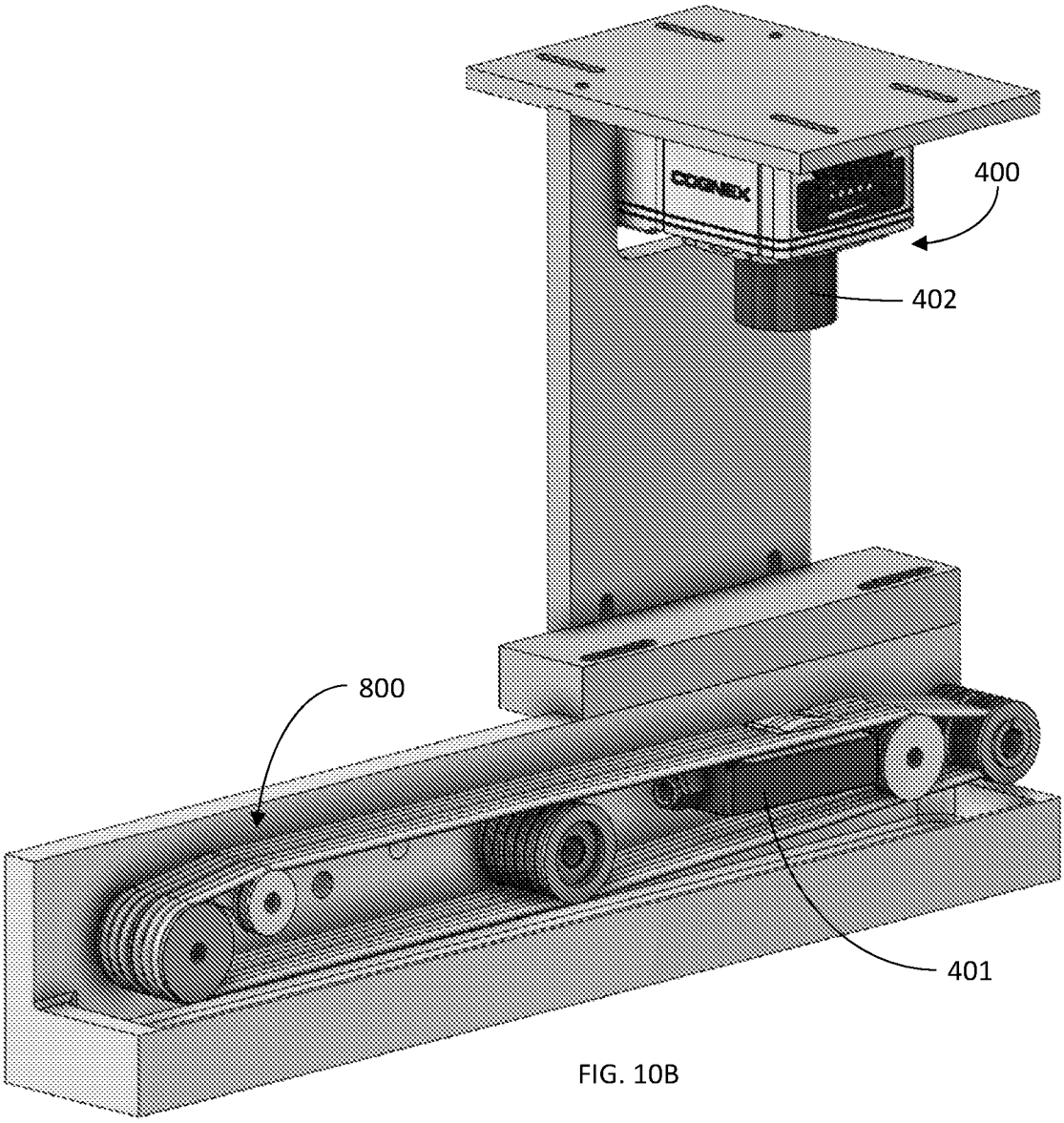
Figure 11:
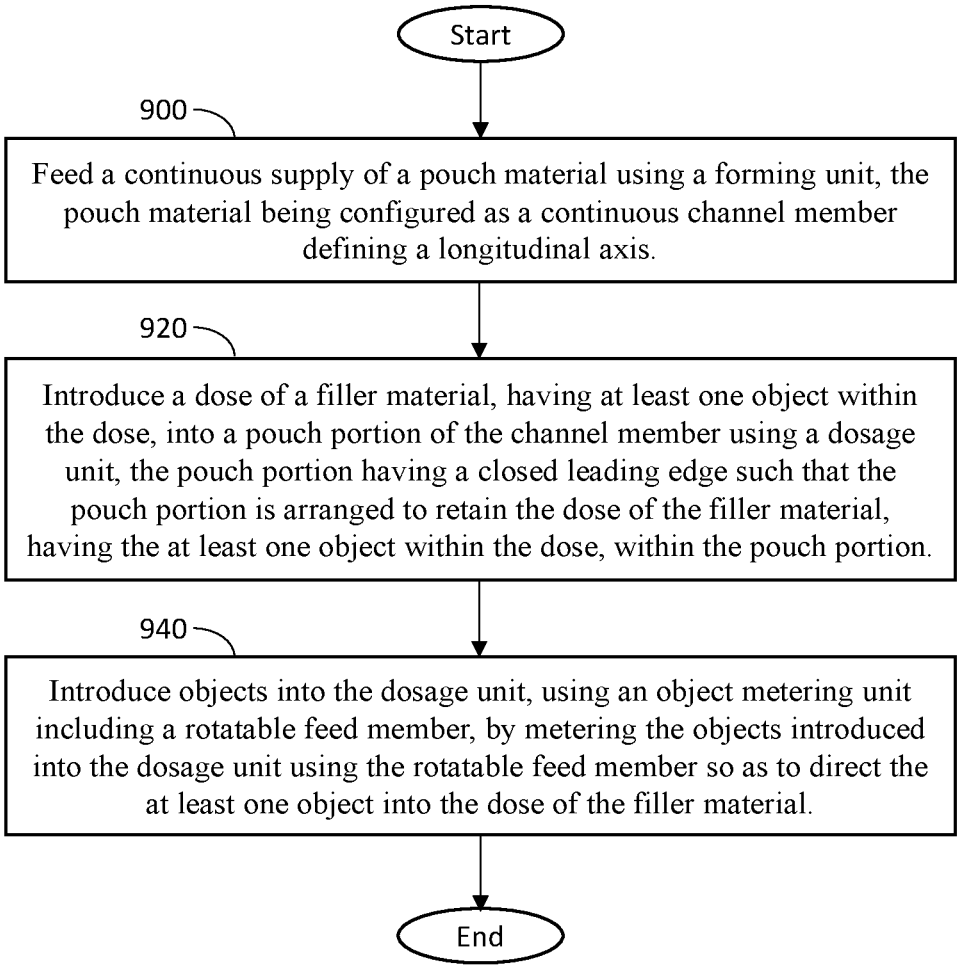
Figure 12A:
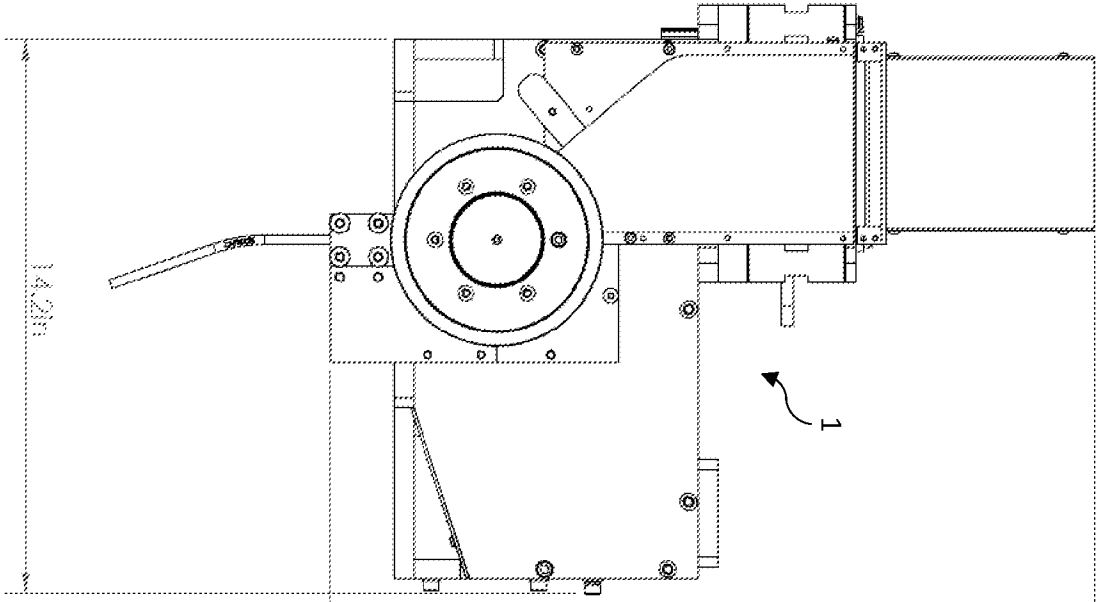
Figure 12B:
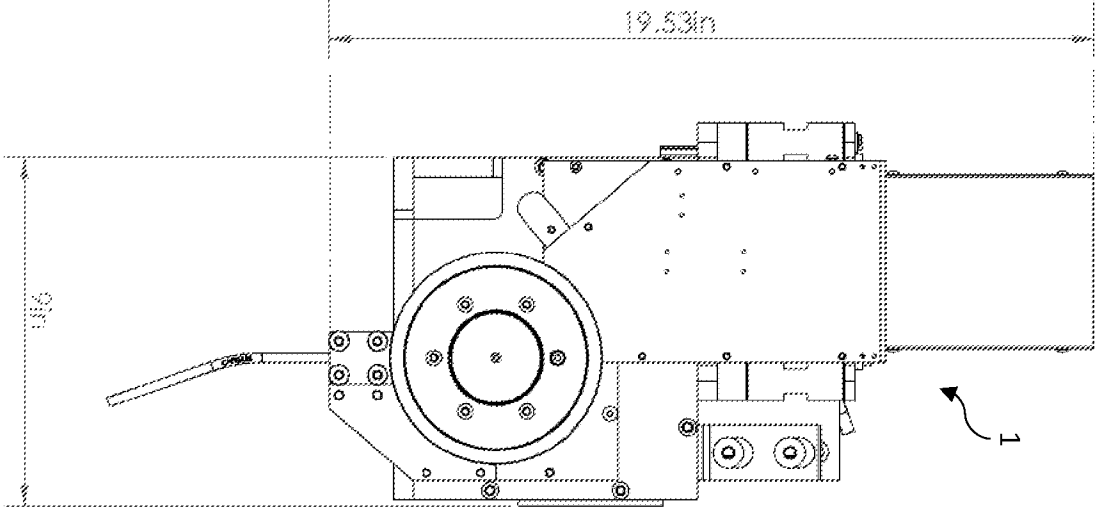
Figure 13A:
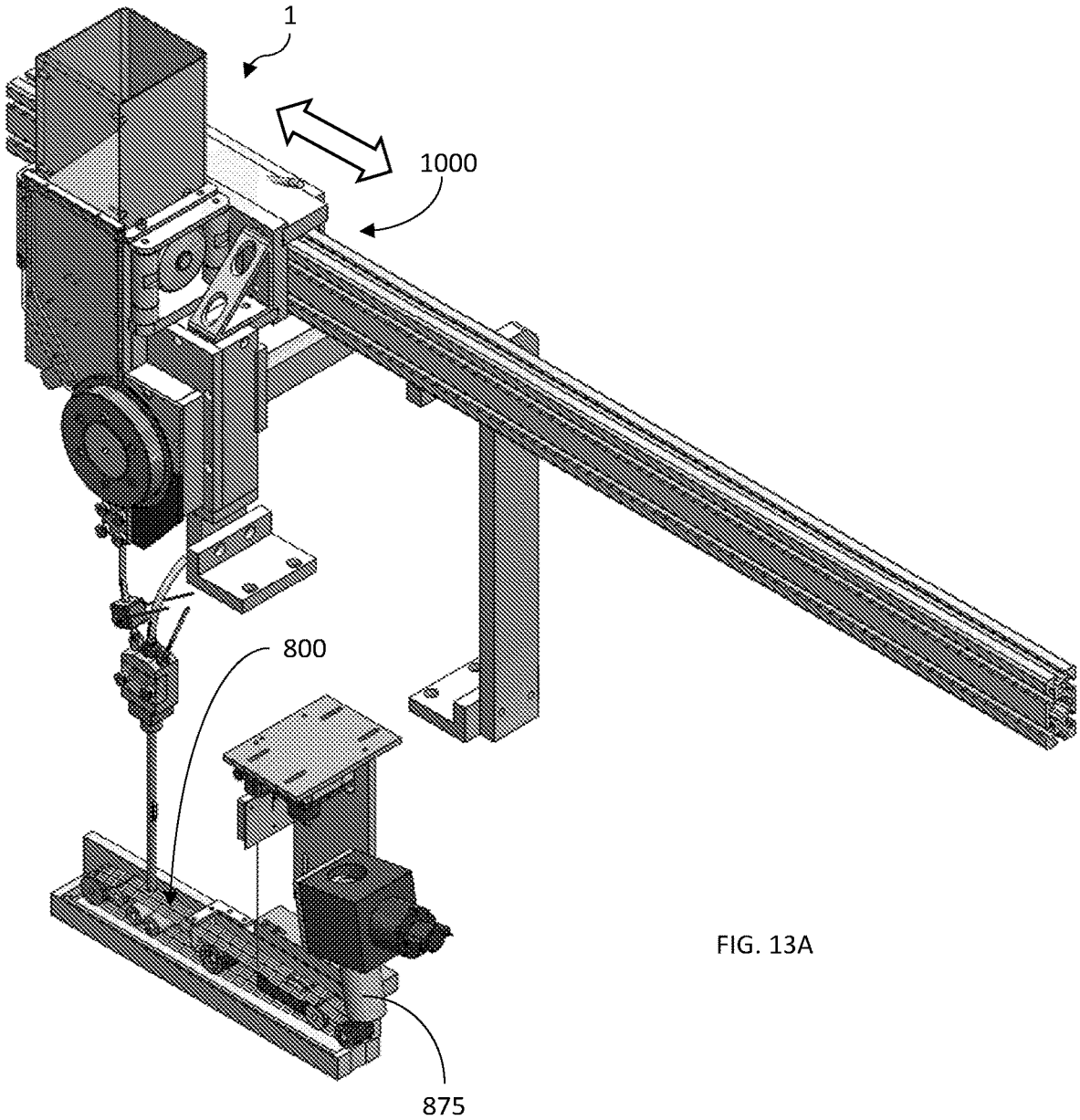
Figure 13B:
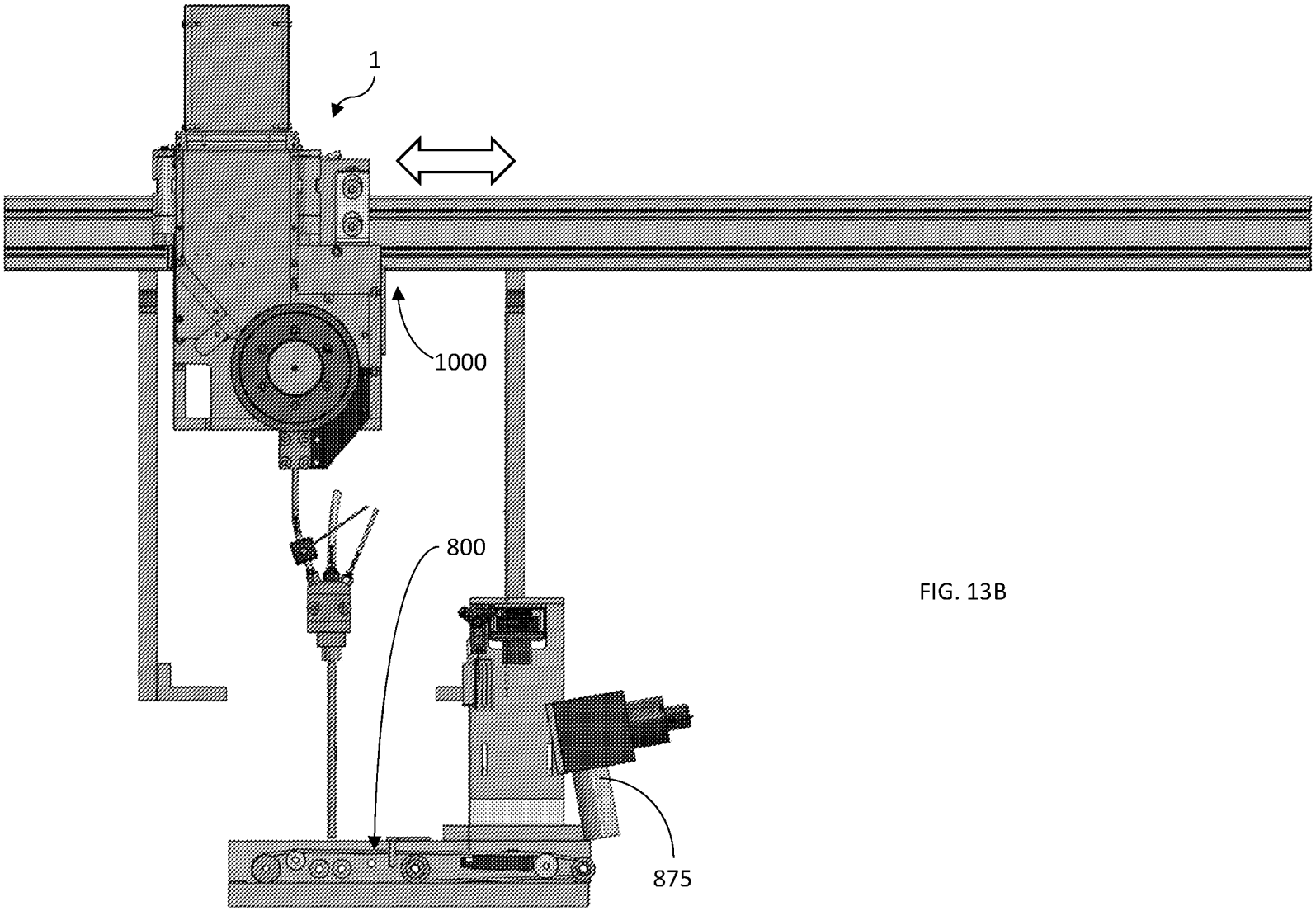

Having thus described the disclosure in general terms, reference will now be made to the accompanying drawings, which are not necessarily drawn to scale, and wherein:

FIG. 1 schematically illustrates an apparatus for manufacturing a pouched product, according to one aspect of the present disclosure;

FIGS. 2-4 are sectional perspective views of the apparatus of FIG. 1;

FIG. 5 schematically illustrate an object metering unit interfaced with an object hopper assembly, according to one aspect of the present disclosure;

FIG. 6 schematically illustrates a rotatable feeder device implemented in an object metering unit, according to one aspect of the present disclosure;

FIG. 7 schematically illustrates an object metering unit interacting with a dosage unit and a forming unit, according to the aspect of the present disclosure shown in FIG. 1;

FIGS. 8A and 8B schematically illustrate a dosage unit interacting with a forming unit, according to alternate aspects of the present disclosure;

FIG. 9 is a sectional perspective view of the apparatus of FIG. 1;

FIG. 10A schematically illustrates an as-formed pouched product conveyed by a conveying unit and inspected by an inspection unit, prior to packaging, according to one aspect of the present disclosure;

FIG. 10B schematically illustrates a conveying unit having an inspection unit operably engaged therewith, prior to packaging, according to one aspect of the present disclosure;

FIG. 11 schematically illustrates a method of manufacturing a pouched product, according to one aspect of the present disclosure;

FIGS. 12A and 12B schematically illustrate an apparatus for manufacturing a pouched product, according to one aspect of the present disclosure, demonstrating that the apparatus can vary in scale, size, and/or footprint; and FIGS. 13A and 13B schematically illustrate an apparatus for manufacturing a pouched product, according to one aspect of the present disclosure, demonstrating the apparatus mounted on a slidable mount for facilitating access to the apparatus for service, maintenance, or repair.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Descriptions of various components of oral types of products and components thereof are set forth in U.S. Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Pat. App. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference.

Representative pouched products may be manufactured using appropriately modified oral product manufacturing equipment. For example, a representative packaging machine, such as a Packaging Machine SB 53-2/T Forming-, Filling- and Sealing Machine from Merz Verpackungsmachinen GmbH may be suitably adapted for use with an object insertion device. G. D SpA, Hauni, and other manufacturers also supply tobacco or non-tobacco material pouching equipment. Oral pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

FIG. 1 illustrates an apparatus for manufacturing a pouched product, such as a tobacco-containing or non-tobacco containing pouched product, incorporating one or more objects (e.g., at least one object such as a rupturable capsule), according to one aspect of the present disclosure, the apparatus being indicated generally by the numeral 1. As shown in FIG. 2, such an apparatus 1 is arranged to removably receive a first bobbin 10 on an unwind spindle assembly 15, the first bobbin 10 having a continuous length of a material, such as a pouch material 20, wound thereon. When the first bobbin 10 is engaged with the apparatus 1, the pouch material 20 is routed from the first bobbin 10 to a forming unit 50 arranged to form a continuous supply of the pouch material 20 into a continuous channel member 25 defining a longitudinal axis.

As such, as the pouch material 20 is unwound from the first bobbin 10, the pouch material 20 is directed around an arrangement of roller members 16, otherwise referred to herein as a dancer assembly 17. The forming unit 50 is configured to cooperate with the first bobbin 10 and the dancer assembly 17 to take up slack in the pouch material 20 and to maintain a certain amount of longitudinal tension on the pouch material 20 as the pouch material 20 is unwound from the first bobbin 10 and fed to the forming unit 50, for example, by a drive system. One of ordinary skill in the art will appreciate that, between the first bobbin 10 and the forming unit 50, the pouch material 20 may be supported, routed, and/or guided by a suitably aligned series of any number of, for example, idler rollers, guideposts, air bars, turning bars, guides, tracks, tunnels, or the like, for directing the pouch material 20 along the desired path. Typical bobbins used by conventional automated pouch-making apparatuses often contain a continuous strip of pouch material 20 of which the length may vary. As such, the apparatus 10 described herein may be configured so as to handle bobbins of that type and size.

As shown in FIGS. 2-4, the forming unit 50 may include one or more roller members arranged to direct the pouch material 20 about a hollow shaft 54 such that the continuous supply of the pouch material 20 can be formed into the continuous channel (e.g., tubular) member 25, and the continuous supply of pouch material 20 configured as the continuous channel member 25 (defining a longitudinal axis) fed along the hollow shaft 54. The forming unit 50 may also include a sealing device 60 arranged to seal, fix, or otherwise engage the lateral edges of the pouch material 20 to form a longitudinally-extending seam, thereby forming the longitudinally-extending continuous channel member 25. A dosage unit 500 is operably engaged with the forming unit 50 and is arranged to introduce a dose of a filler material 130 (see FIG. 10A, e.g., tobacco materials, non-tobacco materials, or powder products with nicotine added), having at least one object 134 (such as, for example, capsules (an outer shell 138 containing an inner payload 141, as shown in FIG. 10A) and/or pellets, mini-capsules and/or mini-pellets, microcapsules, beads, rods, flavoring agent members, or combinations thereof) within the dose, into a pouched portion 116 (see, e.g., FIG. 10A) of the channel member 25 through the hollow shaft 54. The dosage unit 500 may be directly or indirectly engaged with the hollow shaft 54. Upon receiving the dose, the pouched portion 116 has a closed leading edge 162 and, as such, the pouched portion 116 is arranged to retain therein the dose of the filler material 130, having the at least one object 134 within the dose. An object metering unit 300 (see, e.g., FIGS. 1 and 2) is arranged to introduce objects 134 into the dosage unit 500, and includes a rotatable feed member 248 arranged to meter the objects 134 introduced into the dosage unit 500 so as to direct the at least one object 134 into the dose of the filler material 130.

As shown in FIGS. 1, 5, 6A, 6B, and 7, the object metering unit 300 is arranged to direct the at least one object 134 to the dosage unit 500 for introduction of the at least one object 134 into the dose of the filler material 130 (see, e.g., FIG. 10A), prior to or concurrently with introducing the dose into the continuous channel member 25 or the pouched portion 116 thereof. In one example aspect, the object metering unit 300 includes a rotatable feed member 248 shaped, for example, as a wheel, which may be positioned so as to rotate about a first horizontal axis A in a vertical plane. The rotatable feed member 248 may have a peripheral face 458 extending parallel to the first axis A and spaced apart therefrom at a particular radius. The peripheral face 458 defines a plurality of spaced-apart pockets 454, with each pocket 454 being of sufficient shape and size to accommodate one or more of the objects 134. One or more objects 134 can be placed into corresponding individual pockets 454 located at predetermined intervals along the peripheral face 458 of the rotatable feed member 248. A vacuum or negative pressure assembly (not shown) may be in fluid communication with the rotatable feed member 248 such that a vacuum or suction may be applied to each pocket 454, in a radially-inward direction with respect to the first axis A. The vacuum/suction acts to assist in ensuring that each pocket 454 accepts the one or more objects 134, and that the one or more objects 134 within a pocket 454 is/are maintained in that pocket 454 during transport to the dosage unit 500. The one or more objects 134 in each pocket 454 can be dispensed at predetermined intervals into the dosage unit 500 for introduction into the dose of the filler material 130 therein.

In some aspects, the feed member 248, rotating about the axis A, has the angularly spaced-apart pockets 454 arranged to successively receive the at least one object 134 therein at a receiving position (e.g., the twelve o'clock position of the feed member) of the feed member 248, and to dispense the at least one object 134 from each pocket 454 and into the dosage unit 500 upon rotation of the feed member 248 to move successive pockets 454 into a dispensing position (e.g., the 6 o'clock position of the feed member) of the feed member 248. That is, as the rotatable feed member 248 rotates in a clockwise fashion, the one or more objects 134

(not shown) held within the pockets 454 on the peripheral face 458 of the feed member 248 are brought the dispensing position adjacent to the dosage unit 500, where the one or more objects 134 is/are ejected from the pockets 454 into the dosage unit 500. As such, the one or more objects 134 can be discretely or otherwise separately directed into a dose of the filler material 130 by the object metering unit 300. Details of an example rotatable object feed arrangement are further detailed, for example, in U.S. Pat. No. 7,479,098 to Thomas et al., which is incorporated herein by reference in its entirety. In other instances, as additionally shown in FIGS. 1 and 7, the one or more objects 134 may be retained within the pockets 454 of the rotatable feed member 248, by a retention member 475 extending adjacent to the peripheral face 458 of the rotatable feed member 248, and between the receiving position and the dispensing position.

In some instances, as shown, for example, in FIG. 7, an ejection mechanism or object transfer unit 525 (e.g., a pressurized air emission device) is in communication with the rotatable feed member 248 and/or the pockets 454 defined thereby to eject the one or more objects 134 from the pockets 454. For example, pressurized air at about 1.5 psi may be applied to each pocket 454 by the object transfer unit 525, as appropriate, wherein the pressurized air acts to eject the one or more objects 134 therein out of the pocket 454 at the desired time (e.g., when the object 134 carried by the rotatable feed member 248 is located at the desired location (the dispensing position) with respect to the object inlet 506 to the dosage unit 500, as shown in FIGS. 7, 8A, and 8B). That is, in some aspects, the object transfer unit 525 is operably engaged with the object metering unit 300, wherein the object transfer unit 525 is arranged to remove or eject the at least one object 134 from the rotatable feed member 248 and direct the at least one object 134 into the dosage unit 500 for insertion into the dose of the filler material 130. One skilled in the art will appreciate, however, that the rotatable feed member 248 disclosed herein can be effectuated in different manners. For example, the rotatable feed member can, in some instances, be replaced by an endless conveyor also having a peripheral surface defining a series of pockets, and arranged to convey a series of one or more objects in a similar manner to the rotatable feed member. In such instances, the vacuum or negative pressure assembly and/or the retention member may be implemented in a similar manner to the rotatable feed member arrangement.

As shown in FIGS. 1 and 5, in some aspects, the apparatus 1 includes an object hopper assembly 700 for supplying objects 134 to the object metering unit 300. According to one aspect, the object hopper assembly 700 employs gravity and agitation to feed the objects 134 from the object hopper assembly 700 to the object metering unit 300 either directly (e.g., through openings in the lower end of the object hopper assembly 700 disposed adjacent to the peripheral face 458 of the rotatable feed member 248) or via one or more tubular transport members (not shown) in communication therebetween. The object hopper assembly 700 may include an upper hopper 370 that acts as a reservoir for a plurality of objects 134, and provides for supply of the same objects to a lower hopper 390. Passage of objects 134 from the upper hopper 370 to the lower hopper 390 is promoted, in some instances, by vibrating the objects 134 contained in the upper hopper 370 with an agitation device 710 engaged therewith. The lower hopper 390 is shaped so that the objects 134 are stacked therein, at least one level deep. That is, the objects 134 in the lower hopper 390 are received from the upper hopper 370 and stacked on top of one another, but at a depth (when viewed looking toward the object hopper assembly 700) of a single object 134, or of more than one object 134, in correspondence with the size of the receptacles 454 in the rotatable feed member 248. The bottom of the lower hopper 390 is shaped so as to cooperate with a portion of upper region of the rotatable feed member 248 that is positioned so as to rotate in a vertical plane, and the objects 134 are fed from the lower hopper 390 into the pockets or receptacles 454 defined by the peripheral face 458 of that rotatable feed member 248. That is, objects 134 within the lower hopper 390 are delivered in quantities of one or more at a time into the pockets/receptacles 454 defined along a portion of the peripheral face 458 of the upper region of the rotatable feed member 248.

In some aspects, as shown in FIGS. 7, 8A, and 8B, the dosage unit 500 comprises a body member 502 defining a filler channel 510 extending therethough between a filler inlet 512 and an outlet 514. The dosage unit 500 may include a filler hopper 302 (see, e.g., FIG. 1) for storing the filler material 130 and dispensing the filler material 130 in an amount sufficient to constitute a single dose of the filler material 130. A filler transfer unit (not shown, but e.g., a pressurized air source) may be engaged with the filler hopper 302 and arranged to direct the dose of filler material 130 to the dosage unit 500, for example, by a discharge of pressurized air (e.g., about 20 psi). The timing and duration of the discharge of pressurized air may be controlled by, for example, a mechanical valve (not shown). The dose of the filler material 130 may thus be introduced into the filler inlet 512 and pass through the body member 502, via the filler channel 510, which may be directly or indirectly engaged with the hollow shaft 54. The filler transfer unit is thus arranged to direct or facilitate movement of the dose of the filler material 130 through the filler inlet 512 and into the dosage unit 5000/filler channel 510.

The body member 502 may further define an object channel 504 extending at least partially therein and connecting an object inlet 506 to the filler channel 510 between the filler inlet 512 and the outlet 514. In this regard, the one or more objects 134 may be received from the object metering unit 300 through the object inlet 506 and transported to the filler channel 510 via the object channel 504. As such, in some instances, the object channel 504 is arranged to receive the one or more objects 134 via the object inlet 506 and provide a passageway via the object channel 504 for transporting the one or more objects 134 to the filler channel 510. The filler channel 510 is arranged to receive the dose of the filler material 130 via the filler inlet 512, and the one or more objects 134 via the object channel 504. The filler channel 510 may be further configured to transport the dose of the filler material 130 having the one or more objects 134 therein to the outlet 514 for introduction into the pouched portion 116 of the continuous channel member 25 via the hollow shaft 54.

According to one aspect, as shown in FIGS. 7, 8A, and 8B, the filler channel 510 may be linearly configured as defined by the body member 502 from the filler inlet 512 to the outlet 514, with the outlet 514 in communication with the hollow shaft 54 of the forming unit 50. The object channel 504 may be similarly linearly configured, extending from the object inlet 506 to merge into and converge with the filler channel 510, subsequent to the filler inlet 512 and prior to or in coincidence with the outlet 514 of the filler channel 510. However, the configurations of the filler channel 510 and the object channel 504 can vary, as necessary or desired, such that the delivery of the one or more objects 134 into the dose of the filler material 130 is accomplished without damage to the one or more objects 134. In one aspect, the object transfer unit 525 removing/ejecting the one or more objects 134 from the rotatable feed member 248 can be arranged to facilitate directing the one or more objects 134 through the object inlet 506 and along the object channel 504 into the dose of filler material 130 directed along the filler channel 510.

In some aspects, as shown in FIGS. 1, 8A, and 8B, an inspection unit 400 is operably engaged between the object-metering unit 300/rotatable feed member 248 and the forming unit 50. For example, the inspection unit 400 can be operably engaged between the rotatable feed member 248 and the dosage unit 500, operably engaged with the dosage unit 500 (e.g., with the object channel 504 between the object channel inlet 506 and the filler channel 510—see, e.g., FIG. 8A), or otherwise arranged prior to the forming unit 50, to inspect the at least one object and/or the dose of the filler material 130 having the at least one object 134 within the dose, before the dose is directed through the hollow shaft 54 and into the pouched portion 116 of the continuous channel member 25. The inspection unit 400 can include, for example, an emitter 401 arranged to oppose a detector 402 such that the dose of the filler material 130, having the at least one object 134 within the dose, is directed therebetween. In one example, the emitter 401 can comprise a relatively bright light (e.g., from an LED) backlighting the at least one object 134, the at least one object 134 within the dose of the filler material 130, and/or the pouched product 116 having the dose of the filler material 130 and the at least one object 134 therein. The detector may be, for example, a Cognex inspection camera arranged to oppose the emitter (light). With this light-based inspection system, the pouch material and filler material are at least partially translucent, wherein a difference in light transmissivity between the at least one object 134 and the dose of the filler material 130 and/or the pouch material, as detected by the detector, allows the at least one object 134 to be inspected and evaluated. In some instances, the emitter 401 is engaged with the body member 502 so as to extend into the filler channel 510 at or after the engagement of the object channel 504 with the filler channel 510 and before the outlet 514. Similarly, the detector 402 is engaged with the body member 502 so as to extend into the filler channel 510 at or after the engagement of the object channel 504 with the filler channel 510 and before the outlet 514, opposite the filler channel 510 from the emitter 401. In other instances, the emitter 401/detector 402 are opposed to each other and operably engaged between the rotatable feed member 248 and the dosage unit 500 to inspect only the at least one object 134 as shown, for example, in FIG. 8B.

The inspection by the inspection unit 400 can thus occur for just the at least one object 134 (e.g., prior to the combination of the at least one object 134 with the dose of the filler material), upon combination of the at least one object 134 with the dose of the filler material 130 (e.g., about the intersection between the object channel 504 and the filler channel 510), or immediately thereafter prior to the dose of the filler material 130 having the at least one object 134 therein being directed into the hollow shaft 54 of the forming unit 50. Moreover, the inspection can occur as the at least one object 134, or the dose of the filler material 130 having the at least one object 134 therein, is directed, unimpeded, between the emitter 401/detector 402.

In some instances, the object channel 504 and/or the filler channel 510 can have a gate arrangement (not shown) operably engaged therewith for retaining the at least one object 134, or the dose of the filler material 130 having the at least one object 134 therein, for inspection by the inspection unit 400, prior to releasing the at least one object 134 into the dose of the filler material 130, or releasing the dose into the hollow shaft 54. In such instances of the object channel 504 and/or the filler channel 510 having a gate arrangement, if the inspection unit 400 determines that the at least one object 134, by itself or in the dose of the filler material 130, is irregular, the gate arrangement may be further configured to divert that at least one object 134 away from the dose of the filler material 130, or to divert that dose of the filler material 130 having the irregular object therein, away from the hollow channel 54 of the forming unit 50 so as to avoid forming a pouched portion 116 having an irregular object 134 therein. In some aspects, a dose transfer unit (not shown, but e.g., a pressurized air source) can be operably engaged with the dosage unit 500, and arranged to direct the dose of the filler material 130 having the (normal) at least one object 134 from the dosage unit 500 into the hollow shaft 54 of the forming unit 50, and subsequently into the pouched portion 116 of the continuous channel member 25.

In some aspects, the emitter 401 is configured to emit a signal across the object channel 504 or the filler channel 510, wherein the signal interacts with the at least one object 134 or the dose of the filler material 130 having the at least one object 134 therein, before being detected by the detector 402. In this manner, the emitter 401/detector 402 can be configured, for example, to detect the presence/absence of the at least one object 134, to detect the presence/absence of the one or objects 134 in the dose of the filler material 130, determine the integrity (e.g., whether the one or more objects 134 is/are intact or have been damaged upon being combined with the dose of the filler material 130) of the one or more objects 134 alone or in the dose of the filler material 130, and/or determine whether the object channel 504 or the filler channel 510 is clear or blocked. Accordingly, in some aspects, multiple inspection units 400 can be engaged with the body member 502, or between the rotatable insertion member 248 and the body member 502, as necessary or desired, to monitor the condition of the object channel 504 and/or the filler channel 510 at various locations on the body member 502.

In some aspects, the emitter 401 is a light emitter and the detector 402 is arranged to detect light transmitted about/through the at least one object 134 or through the dose of the filler material 130, having the at least one object 134 within the dose (e.g., backlighting the at least one object 134, or the dose of the filler material 130 having the at least one object 134 therein), to determine, for example, a presence or absence of the at least one object 134 or to determine an integrity of the at least one object 134. The emitted light may be of any suitable wavelength (visible, infrared, etc.), as necessary or desired, so as to be at least partially attenuated by the at least one object 134, in contrast with the light passing around the at least one object 134, or the light being attenuated by the filler material 130, upon interaction of the emitted light therewith. The detector 402 may be in operable communication with, for example, a vision system configured to process the detected light to determine a contrast between the at least one object 134 and the filler material 134 and/or to determine whether the backlit image of the one or more objects 134 corresponds with the expected object shape or configuration (e.g., whether the detected capsule is shaped as-expected as a model capsule or whether an irregular shape indicates that the capsule has ruptured). One skilled in the art will appreciate, however, that the inspection unit 400 may be configured in different manners, besides as a light emitter/detector, as long as sufficient and appropriate to provide for contrast/discernment of the at least one object 134 or between the at least one object and the filler material, and to allow the configuration/integrity of the at least one object to be assessed and verified.

In one aspect, the body member 502 may define a purge channel 520 in communication with the object channel 504 between the object inlet 506 and the filler channel 510 and/or in communication with the filler channel 510 between the filler inlet 512 and the object channel 504 (with the latter being illustrated in FIGS. 7, 8A, and 8B). The purge channel 520 may be fluidly connect to a blower assembly or other source 521 (see, e.g., FIG. 1) of a purge substance such as pressurized air for discharging air into the purge channel 520 so as to assist in moving any residual objects and/or filler material from the object channel 504 and/or the filler channel 510. In some instances, the blower/pressurized air assembly may provide, for instance, approximately 15-40 psi of force for a flow duration, for example, of approximately 15 seconds to 5 minutes, to assist with removing residual objects and/or filler material from the object channel 504 and/or the filler channel 510. In some aspects, the source 521 of the purge substance may include, for example, a cleaning substance in addition to or instead of pressurized air. In other aspects, a clearing unit (not shown, but e.g., a mechanical rod or pipe cleaner) can be operably engaged with the dosage unit 500, with the clearing unit being arranged to be selectively actuated (e.g., the mechanical rod or pipe cleaner introduced into and moved along the object channel 504 or along the filler channel 510) so as to clear the dosage unit 500 of any residual objects or filler material remaining therein.

As shown, for example, in FIGS. 3 and 9, a leading edge or end 162 of the continuous channel member 25 may be closed/sealed such that a charge or dose of filler material 130, and the object(s) 134 introduced into the dose of the filler material 130, in the dosage unit 500 are introduced into and contained within the continuous channel member 25 proximate to the leading end 162. The leading end 162 may be closed/sealed via a closing and dividing component 600 of the forming unit 50 arranged to close/seal a first portion 26 (see, e.g., FIG. 10A) of the continuous channel member 25 to form the closed leading end 162 of a pouched portion 116. The closing and dividing component 600 may also be arranged to form a closed trailing edge or end 165 of a previous pouched portion 116. In this regard, the closing and dividing component 600 may also be arranged to close a second portion 27 of the continuous channel member 25 to form the closed trailing end 165 of the pouched portion 116. The closing and dividing component 600 may also be arranged to form a closed leading edge 162 of a subsequent pouched portion 116. That is, the closing and dividing component 600 may be arranged to close the trailing end 165 of one pouched portion 116 while simultaneously closing the leading end 162 of a subsequent pouched portion 116 formed from the continuous channel member 25. In this regard, the closing and dividing component 600 may close the ends 162, 165 by heat-sealing, a suitable adhesive, or other suitable sealing mechanism for the pouch material.

Furthermore, the closing and dividing component 600 may be arranged to divide the continuous channel member 25, between the closed trailing end 165 and the closed leading end 162 of serially-disposed pouched portions 116, along the longitudinal axis of the continuous channel member 25, and into a plurality of discrete pouched portions 116 such that each discrete pouched portion 116 includes a dose of the filler material 130 from the dosage unit 500 having at least one of the objects 134 from the object metering unit 300 therein, as shown in FIG. 10A and as described further herein. In this regard, the closing and dividing component 600 may include a blade, heated wire, or other cutting arrangement for severing the continuous channel member 25 into discrete pouched portions 116. For example, the closing and dividing component 600 may include first and second arm members 602, 604 configured to interact to close and divide the continuous channel member 25, as generally shown in FIGS. 3 and 4.

In operation, a charge or dose of filler material 130 (i.e., an amount suitable for inserting in an individual pouched portion 116) is supplied to the pouched portion 116 by the dosage unit 500 after the leading end 162 has been closed, but prior to the closing of the trailing end 165. Similarly, one or more objects 134 is supplied to the dose of filler material 130 by the object metering unit 300 and the combined dose then directed to the forming unit 50 after the leading end 162 of the pouched portion 116 has been closed, but prior to the closing of the trailing end 165 of the pouched portion 116. After receiving the dose of filler material 130 having the one or more objects 134 therein, the discrete individual pouched portion 116 is formed by closing the trailing end 165 and severing the closed pouched portion 116 from the continuous channel member 25 such that an individual pouched product, incorporating at least one object 134 within the dose of the filler material 130, is formed.

In some instances, the apparatus 1 may be configured and arranged to produce approximately 300 pouched portions 116 per minute. A conveying unit 800 may be provided proximate to the closing and dividing component 600 such that, after being severed from the continuous channel member 25, each individual pouched portion 116 (at this point, an as-formed pouched product) is received by the conveying unit 800 and transported away from the apparatus 1 to, for example, a storage bin or container 850 (see, e.g., FIG. 2) or a packaging unit (not shown). In some instances, each individual pouched portion 116 may be transported by the conveying unit 800 to operably engage and be directed through an inspection unit 400, as disclosed herein, prior to the storage bin/container 850 or the packaging unit. That is, in some aspects as shown in FIGS. 10A and 10B, the inspection unit 400 includes an emitter 401 configured to emit a signal across the conveyor 800, wherein the signal interacts with the individual pouched portion 116 having the dose of the filler material 130 and the at least one object 134 therein, before being detected by the detector 402. In this manner, the emitter 401/detector 402 can be configured, for example, to detect the presence/absence of the one or objects 134 within the dose of the filler material 130 within the pouched portion 116 and/or to determine the integrity (e.g., whether the one or more objects 134 is/are intact or have been damaged upon being combined with the dose of the filler material 130 in the pouched portion 116) of the one or more objects 134 within the dose of the filler material 130 within the pouched portion 116.

In some aspects, the emitter 401 is a light emitter and the detector 402 is arranged to detect light transmitted through the pouched portion/pouched product 116, having therein the dose of the filler material 130 and the at least one object 134 therein (e.g., backlighting the pouched portion/pouched product 116 having the dose of the filler material 130 and the at least one object 134 therein), to determine, for example, a presence or absence of the at least one object 134 or to determine an integrity of the at least one object 134 within the pouched portion/pouched product 116. The emitted light may be of any suitable wavelength (visible, infrared, etc.), as necessary or desired, so as to be at least partially attenuated by the at least one object 134, in contrast with the attenuation by the filler material 130 and the pouch material, upon interaction of the emitted light therewith. The detector 402 may be in operable communication with, for example, a vision system configured to process the detected light to determine a contrast between the at least one object 134 and the filler material 134 and pouch material and/or to determine whether the backlit image of the one or more objects 134 corresponds with the expected object shape or configuration (e.g., whether the detected capsule is shaped as-expected as a model capsule or whether an irregular shape indicates that the capsule has ruptured). One skilled in the art will appreciate, however, that the inspection unit 400 may be configured in different manners, besides as a light emitter/detector, as long as sufficient and appropriate to provide for contrast/discernment between the at least one object and the filler material and pouch material, and to allow the configuration/integrity of the at least one object to be assessed and verified. For example, the emitter/detector may be configured to measure microwave density of the one or more objects 134, or in other instances, the emitter/detector may be capable of determining whether an object is leaking its payload by being configured to sense an ultraviolet (UV) tracer originally included in the payload of the object. Other emitter/detector systems as known by those of ordinary skill in the art may be employed for determining, for example, the absence and/or presence of objects, object defects, and other detectable object properties within the pouched portion/pouched product 116.

In some aspects, the conveying unit 800 is arranged to divert any pouched portion/pouched product 116, determined by the inspection unit 400 to demonstrate the absence of the at least one object 134 within the pouched portion/pouched product 116 or to demonstrate a lack of integrity of the at least one object 134 within the pouched portion/pouched product 116, away from the packaging unit or storage bin/container (e.g., by way of a diverter device 875 as shown in FIGS. 13A and 13B). In such aspects, pouched portions/pouched products 116 determined to have object(s) lacking integrity can be diverted by the diverter device 875 of the conveying unit 800 to be rejected or discarded. In addition, pouched portions/pouched products determined to lack the object(s) therein can be diverted by the diverter device 875 of the conveyor 800 and packaged as pouched products without any objects therein.

Still another aspect comprises a method of manufacturing a pouched product, as disclosed herein and schematically illustrated in FIG. 11. More particularly, such a method comprises feeding a continuous supply of a pouch material using a forming unit, the pouch material being configured as a continuous channel member defining a longitudinal axis (Block 900). A dose of a filler material, having at least one object within the dose, is introduced into a pouched portion of the channel member using a dosage unit, the pouched portion having a closed leading edge such that the pouched portion is arranged to retain the dose of the filler material, having the at least one object within the dose, within the pouched portion (Block 920). Objects are introduced into the dosage unit, using an object metering unit including a rotatable feed member, by metering the objects introduced into the dosage unit using the rotatable feed member so as to direct the at least one object into the dose of the filler material (Block 940).

The present disclosure can be utilized with a variety of filler materials without departing from the invention. In certain embodiments, the filler material comprises a filler such as microcrystalline cellulose (generally in an amount of at least 20% by weight), at least one active ingredient such as one or more of botanical materials, stimulants, amino acids, vitamins, antioxidants, cannabinoids, pharmaceutical agents, nicotine (in base, salt or complex form), and combinations thereof, and optionally further ingredients such as cellulose derivatives (e.g., hydroxypropylcellulose), organic acids, salts, sweeteners, flavorants, and tobacco. See, for example, the types of oral compositions set forth in US2021/0068447 to Keller et al.; US2021/0169889 to Keller et al.; US2021/0177043 to Gerardi et al.; US2021/0206554 to Holton Jr. et al; and US2022/0071984 to Poole et al, each of which is incorporated by reference in its entirety.

Many modifications and other embodiments of the inventions set forth herein will come to mind to one skilled in the art to which these disclosed embodiments pertain having the benefit of the teachings presented in the foregoing descriptions and the associated drawings. Therefore, it is to be understood that embodiments of the invention are not to be limited to the specific embodiments disclosed and that modifications and other embodiments are intended to be included within the scope of the invention. For example, as shown in FIGS. 12A and 12B, the apparatus 1 and/or any of the components thereof can, in some aspects, be varied in scale or size (increased or decreased) to adapt the apparatus 1 to processes/applications in which the implementation space is limited or irregular, or to otherwise reduce the footprint of the apparatus 1. In another example, as shown in FIGS. 13A and 13B, the apparatus 1 may be mounted on a slide device 1000. The movable/slidable mounting of the apparatus 1 on the slide device 1000, for example, allows the apparatus 1 to be movable to facilitate access to the apparatus 1 and/or surrounding components (such as the conveying unit 800) for service, maintenance, or repair purposes.

Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

It should be understood that although the terms first, second, etc. may be used herein to describe various steps or calculations, these steps or calculations should not be limited by these terms. These terms are only used to distinguish one operation or calculation from another. For example, a first calculation may be termed a second calculation, and, similarly, a second step may be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof.

Therefore, the terminology used herein is for the purpose of describing particular embodiments only and is not intended to be limiting.

That which is claimed:

1. An apparatus for manufacturing a pouched product, the apparatus comprising:

a forming unit arranged to feed a continuous supply of a pouch material configured as a continuous channel member defining a longitudinal axis;

a dosage unit operably engaged with the forming unit and arranged to introduce a dose of a filler material, having at least one object within the dose, into a pouched portion of the channel member, the pouched portion having a closed leading edge such that the pouched portion is arranged to retain the dose of the filler material, having the at least one object within the dose, within the pouched portion; and an object metering unit arranged to introduce objects into the dosage unit, and including a rotatable feed member arranged to meter the objects introduced into the dosage unit so as to direct the at least one object into the dose of the filler material.

2. The apparatus of claim 1, comprising an inspection unit operably engaged between the object metering unit and the forming unit and arranged to inspect the at least one object, or the dose of the filler material having the at least one object within the dose, the inspection unit including an emitter arranged to oppose a detector such that at least the at least one object is directed therebetween.

3. The apparatus of claim 2, wherein the inspection unit is arranged between the object metering unit and the dosage unit, or is operably engaged with the dosage unit, to inspect the at least one object, prior to the at least one object being introduced into the dose of the filler material.

4. The apparatus of claim 2, wherein the inspection unit is operably engaged with the dosage unit, prior to the forming unit, and arranged to inspect the at least one object upon or after the at least one object being introduced into the dose of the filler material.

5. The apparatus of claim 2, wherein the emitter is a light emitter and wherein the detector is arranged to detect light transmitted through and around the at least one object, or through and around the at least one object within the dose of the filler material, to determine an integrity of the at least one object or to determine a presence or absence of the at least one object within the dose of the filler material.

6. The apparatus of claim 1, wherein the forming unit is arranged to close a first portion of the channel member to form the closed leading edge of the pouched portion and a closed trailing edge of a previous pouched portion, and to close a second portion of the channel member to form a closed trailing edge of the pouched portion and a closed leading edge of a subsequent pouched portion.

7. The apparatus of claim 6, wherein the forming unit is arranged to divide the channel member through the longitudinal axis, between the closed trailing edge and the closed leading edge of the respective pouched portions serially disposed along the longitudinal axis of the channel member, into a plurality of discrete pouched products such that each discrete pouched product includes therein the dose of the filler material, having the at least one object within the dose.

8. The apparatus of claim 7, comprising a conveying unit arranged to receive the pouched products from the forming unit and to convey the pouched products to a packaging unit for packaging the pouched products.

9. The apparatus of claim 8, comprising an inspection unit operably engaged with the conveying unit and arranged prior to the packaging unit to inspect each pouched product directed to the packaging unit, the inspection unit including an emitter arranged to oppose a detector such that the pouched products are conveyed therebetween.

10. The apparatus of claim 9, wherein the emitter is a light emitter and wherein the detector is arranged to detect light transmitted by the emitter through each conveyed pouched product to determine a presence or absence of the at least one object within the pouched product or to determine an integrity of the at least one object within the pouched product.

11. The apparatus of claim 10, wherein the conveying unit is arranged to divert any pouched product, determined by the inspection unit to demonstrate the absence of the at least one object within the pouched product or to demonstrate a lack of integrity of the at least one object within the pouched product, away from the packaging unit.

12. The apparatus of claim 1, wherein the dosage unit comprises a body member defining a filler channel extending therethrough between a filler inlet and an outlet, and an object channel extending from an object inlet into communication with the filler channel between the filler inlet and the outlet, the object channel being arranged to receive the at least one object through the object inlet from the object metering unit in communication therewith, and to direct the at least one object into the filler channel, and the filler channel being arranged to receive the dose of the filler material through the filler inlet, to receive the at least one object from the object channel into the dose of the filler material, and to direct the dose of the filler material including the at least one object to the outlet for introduction of the dose into the pouched portion of the channel member.

13. The apparatus of claim 12, wherein the body member defines a purge channel in communication with the object channel or the filler channel, before the outlet, the purge channel being arranged to receive a selectively actuated flow of a purge substance therein to clear the object channel or the filler channel of any objects or filler material remaining therein.

14. The apparatus of claim 1, comprising an object transfer unit operably engaged with the object metering unit, the object transfer unit being arranged to remove the at least one object from the rotatable feed member and direct the at least one object into the dosage unit and into the dose of the filler material.

15. The apparatus of claim 1, comprising a filler transfer unit operably engaged with the dosage unit, the filler transfer unit being arranged to direct the dose of the filler material into the dosage unit.

16. The apparatus of claim 1, comprising a dose transfer unit operably engaged with the dosage unit, the dosage transfer unit being arranged to direct the dose of the filler material having the at least one object from the dosage unit into the pouched portion.

17. The apparatus of claim 1, comprising a clearing unit operably engaged with the dosage unit, the clearing unit being arranged to be selectively actuated to clear the dosage unit of any objects or filler material remaining therein.

18. The apparatus of claim 1, wherein the feed member is rotatable about an axis and comprises a peripheral surface extending at a radius about the axis, the peripheral surface defining a plurality of angularly spaced-apart pockets each arranged to successively receive the at least one object therein at a receiving position of the feed member, and to dispense the at least one object from each pocket and into the dosage unit upon rotation of the feed member to move successive pockets into a dispensing position of the feed member.

19. The apparatus of claim 18, comprising a retention device operably engaged with the feed member and arranged to retain the at least one object within the respective pocket of the feed member upon rotation of the feed member between the receiving position and the dispensing position.

20. The apparatus of claim 19, wherein the retention device comprises a negative pressure assembly disposed in fluid communication with the feed member and arranged to apply a negative pressure to at least a portion of the pockets to maintain the at least one object within the at least a portion of the pockets during rotation of the feed member between the receiving position and the dispensing position.

21. The apparatus of claim 19, wherein the retention device comprises a retaining member disposed adjacent to the peripheral surface of the feed member and having a retention surface extending adjacent to and along the peripheral surface at least between the receiving position and the dispensing position of the feed member.

22. The apparatus of claim 18, comprising a hopper assembly arranged to receive a plurality of the objects and to manipulate the plurality of objects so as to feed the at least one object therefrom into each pocket defined by the peripheral surface of the feeder device upon rotation thereof to the receiving position.

23. The apparatus of claim 22, comprising an agitation device arranged to interact with the hopper assembly so as to agitate the objects therein and facilitate feeding of the objects into the pockets of the feeder device.

24. The apparatus of claim 1, wherein the object metering unit is arranged to introduce objects including capsules, pellets, microcapsules, beads, rods, flavoring agent members, or combinations thereof.

25. A method of manufacturing a pouched product, the method comprising:

feeding a continuous supply of a pouch material using a forming unit, the pouch material being configured as a continuous channel member defining a longitudinal axis;

introducing a dose of a filler material, having at least one object within the dose, into a pouched portion of the channel member using a dosage unit, the pouched portion having a closed leading edge such that the pouched portion is arranged to retain the dose of the filler material, having the at least one object within the dose, within the pouched portion; and introducing objects into the dosage unit, using an object metering unit including a rotatable feed member, by metering the objects introduced into the dosage unit using the rotatable feed member so as to direct the at least one object into the dose of the filler material.

26. The method of claim 25, comprising inspecting the at least one object, or the dose of the filler material having the at least one object within the dose, using an inspection unit operably engaged between the object metering unit and the forming unit, the inspection unit including an emitter arranged to oppose a detector such that at least the at least one object is directed therebetween.

27. The method of claim 26, comprising inspecting the at least one object with the inspection unit arranged between the object metering unit and the dosage unit, or operably engaged with the dosage unit, prior to the at least one object being introduced into the dose of the filler material.

28. The method of claim 26, comprising inspecting the at least one object upon or after the at least one object being introduced into the dose of the filler material, with the inspection unit operably engaged with the dosage unit, prior to the forming unit.

29. The method of claim 26, wherein the emitter is a light emitter and wherein inspecting the at least one object, or the dose of the filler material having the at least one object within the dose, comprises detecting, using the detector, light transmitted by the emitter through and around the at least one object, or through and around the at least one object within the dose of the filler material, to determine an integrity of the at least one object or to determine a presence or absence of the at least one object within the dose of the filler material.

30. The method of claim 25, comprising closing a first portion of the channel member, using the forming unit, to form the closed leading edge of the pouched portion and a closed trailing edge of a previous pouched portion.

31. The method of claim 30, comprising closing a second portion of the channel member, using the forming unit, to form a closed trailing edge of the pouched portion and a closed leading edge of a subsequent pouched portion.

32. The method of claim 31, comprising dividing the channel member through the longitudinal axis, using the forming unit, between the closed trailing edge and the closed leading edge of the respective pouched portions serially disposed along the longitudinal axis of the channel member, to form the channel member into a plurality of discrete pouched products with each discrete pouched product including therein the dose of the filler material, having the at least one object within the dose.

33. The method of claim 32, comprising conveying the pouched products, using a conveying unit arranged to receive the pouched products from the forming unit, to a packaging unit for packaging the pouched products.

34. The method of claim 33, comprising inspecting each pouched product directed to the packaging unit, using an inspection unit operably engaged with the conveying unit and arranged prior to the packaging unit, the inspection unit including an emitter arranged to oppose a detector such that the pouched products are conveyed therebetween.

35. The method of claim 34, wherein the emitter is a light emitter and wherein inspecting each pouched product comprises detecting, using the detector, light transmitted by the emitter through each conveyed pouched product to determine a presence or absence of the at least one object within the pouched product or to determine an integrity of the at least one object within the pouched product.

36. The method of claim 35, comprising diverting, using the conveying unit, any pouched product determined by the inspection unit to demonstrate the absence of the at least one object within the pouched product or to demonstrate a lack of integrity of the at least one object within the pouched product, away from the packaging unit.

37. The method of claim 25, wherein the dosage unit comprises a body member defining a filler channel extending therethrough between a filler inlet and an outlet, and an object channel extending from an object inlet into communication with the filler channel between the filler inlet and the outlet, and wherein the method comprises receiving the at least one object through the object inlet from the object metering unit in communication therewith and directing the at least one object into the filler channel, receiving the dose of the filler material through the filler inlet, receiving the at least one object from the object channel into the dose of the filler material, and directing the dose of the filler material including the at least one object to the outlet for introduction of the dose into the pouched portion of the channel member.

38. The method of claim 37, wherein the body member defines a purge channel in communication with the object channel or the filler channel, before the outlet, and wherein the method comprises receiving a selectively actuated flow of a purge substance in the purge channel to clear the object channel or the filler channel of any objects or filler material remaining therein.

39. The method of claim 25, comprising removing the at least one object from the rotatable feed member, and directing the at least one object into the dosage unit and into the dose of the filler material, using an object transfer unit operably engaged with the object metering unit.

40. The method of claim 25, comprising directing the dose of the filler material into the dosage unit, using a filler transfer unit operably engaged with the dosage unit.

41. The method of claim 25, comprising directing the dose of the filler material having the at least one object from the dosage unit into the pouched portion, using a dose transfer unit operably engaged with the dosage unit.

42. The method of claim 25, comprising selectively actuating a clearing unit operably engaged with the dosage unit to clear the dosage unit of any objects or filler material remaining therein.

43. The method of claim 25, wherein the feed member is rotatable about an axis and comprises a peripheral surface extending at a radius about the axis, the peripheral surface defining a plurality of angularly spaced-apart pockets, and wherein the method comprises successively receiving the at least one object in each pocket at a receiving position of the feed member, and dispensing the at least one object from each pocket and into the dosage unit upon rotation of the feed member to move successive pockets into a dispensing position of the feed member.

44. The method of claim 43, comprising retaining the at least one object within the respective pocket of the feed member, using a retention device operably engaged with the feed member, upon rotation of the feed member between the receiving position and the dispensing position.

45. The method of claim 44, wherein the retention device comprises a negative pressure assembly disposed in fluid communication with the feed member, and wherein the method comprises applying a negative pressure to at least a portion of the pockets to maintain the at least one object within the at least a portion of the pockets during rotation of the feed member between the receiving position and the dispensing position.

46. The method of claim 44, wherein the retention device comprises a retaining member disposed adjacent to the peripheral surface of the feed member, and wherein the method comprises retaining the at least one object within the at least a portion of the pockets during rotation of the feed member between the receiving position and the dispensing position, using a retention surface of the retaining member extending adjacent to and along the peripheral surface at least between the receiving position and the dispensing position of the feed member.

47. The method of claim 43, comprising receiving a plurality of the objects in a hopper assembly and manipulating the plurality of objects so as to feed the at least one object from the hopper assembly into each pocket defined by the peripheral surface of the feeder device upon rotation thereof to the receiving position.

48. The method of claim 47, comprising agitating the objects within the hopper assembly using an agitation device arranged to interact therewith to facilitate feeding of the objects into the pockets of the feeder device.

49. The method of claim 25, wherein introducing objects into the dosage unit comprises introducing objects, including capsules, pellets, microcapsules, beads, rods, flavoring agent members, or combinations thereof, into the dosage unit.

* * * * *